US007247066B2

(12) United States Patent
Harada et al.

(10) Patent No.: US 7,247,066 B2
(45) Date of Patent: Jul. 24, 2007

(54) REMOTE OPERATION SYSTEM FOR OUTBOARD MOTOR

(75) Inventors: Yoshihiro Harada, Saitama (JP); Shinsaku Nakayama, Saitama (JP); Taiichi Otobe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 34 days.

(21) Appl. No.: 11/210,483

(22) Filed: Aug. 24, 2005

(65) Prior Publication Data

US 2006/0046585 A1 Mar. 2, 2006

(30) Foreign Application Priority Data

Aug. 25, 2004 (JP) ..... 2004-245888
Aug. 25, 2004 (JP) ..... 2004-245889
Aug. 25, 2004 (JP) ..... 2004-245890
Aug. 25, 2004 (JP) ..... 2004-245891
Aug. 25, 2004 (JP) ..... 2004-245892

(51) Int. Cl.
*B63H 21/22* (2006.01)
*B63H 10/04* (2006.01)

(52) U.S. Cl. ..... 440/84; 440/86; 440/87

(58) Field of Classification Search ..... None
See application file for complete search history.

(56) References Cited

U.S. PATENT DOCUMENTS 5,094,122 A * 3/1992 Okita ..... 74/480 B
5,101,862 A * 4/1992 Leete ..... 137/899
5,352,138 A * 10/1994 Kanno ..... 440/1
5,492,493 A * 2/1996 Ohkita ..... 440/86
6,280,269 B1 * 8/2001 Gaynor ..... 440/84
2004/0198109 A1 * 10/2004 Ochiai ..... 440/87
2005/0014427 A1 * 1/2005 Yoda et al. ..... 440/86

FOREIGN PATENT DOCUMENTS

JP 57-153311 9/1982
JP 2002-137795 5/2002

* cited by examiner

*Primary Examiner*—Samuel Morano
*Assistant Examiner*—Daniel V Venne
(74) *Attorney, Agent, or Firm*—Carrier, Blackman & Associates, P.C.; Joseph P. Carrier; William D. Blackman

(57) ABSTRACT

A remote operation system for an outboard motor includes a remote control box installed at a cockpit of the boat and a lever attached to a support shaft that is rotatably accommodated in the remote control box for being manipulated by an operator, a plurality of sensors, such as a potentiometer and a rotary encoder provided to generate outputs indicative of an angle of rotation of the support shaft through the lever manipulation, respectively, and a control unit which controls operation of a throttle actuator and a shift actuator based on at least one of the outputs of the sensors, thereby improving reliability and enabling continued regulation of throttle opening and change of shift position even if a failure occurs in one of sensors.

18 Claims, 19 Drawing Sheets

REMOTE OPERATION SYSTEM FOR OUTBOARD MOTOR

BACKGROUND OF THE INVENTION

1. Field of the Invention

This invention relates to a remote operation system for an outboard motor.

2. Description of the Related Art

The prior art includes outboard motor remote operation systems that enable the throttle valve of the internal combustion engine and/or the clutch of a shift mechanism incorporated in the outboard motor to be operated by manipulating the lever of an operation unit (remote control box) installed at a distance from the outboard motor. Such systems are ordinarily configured to use a potentiometer or other such analog sensor to detect the lever manipulation angle and regulate throttle opening by controlling the operation of an actuator connected to the throttle valve in accordance with the detected angle, and to change the shift position by controlling the operation of an actuator connected to the clutch in accordance with the direction of lever operation, as taught, for example, in Japanese Laid-Open Patent Application No. 2002-137795 (e.g., paragraphs 0011 to 0015 etc.) and Japanese Laid-Open Patent Application No. Sho 57(1982)-153311.

The conventional outboard motor remote operation systems are configured to drive the shift actuator and throttle actuator based on a single sensor output. They are therefore deficient in reliability because a sensor failure simultaneously makes both regulation of throttle opening and change of shift position impossible.

SUMMARY OF THE INVENTION

An object of the invention is therefore to overcome the foregoing problem by providing a remote operation system for an outboard motor with a plurality of sensors that improves reliability and enables continued regulation of throttle opening and change of shift position even if a failure occurs in one of the sensors.

In order to achieve the objects, there is provided a remote operation system for an outboard motor mounted on a stern of a boat and having an internal combustion engine and a propeller powered by the engine to propel the boat in a forward direction or in a reverse direction in response to a shift position selected by a shift mechanism, comprising: a remote control box installed at a cockpit of the boat; a throttle actuator installed in the outboard motor and connected to a throttle valve of the engine to open and close the throttle valve; a shift actuator installed in the outboard motor and operating a clutch of the shift mechanism to select the shift position from among a forward position, a reverse position and a neutral position; a lever attached to a support shaft that is rotatably accommodated in the remote control box for being manipulated by an operator; a plurality of sensors connected to the support shaft and each generating outputs indicative of an angle of rotation of the support shaft through the lever manipulation; and a control unit electrically connected to the throttle actuator, the shift actuator and the sensors and controlling operation of the throttle actuator and the shift actuator based on at least one of the outputs of the sensors.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Embodiments of a remote operation system for an outboard motor according to the present invention will now be explained with reference to the attached drawings.

Figure 1:
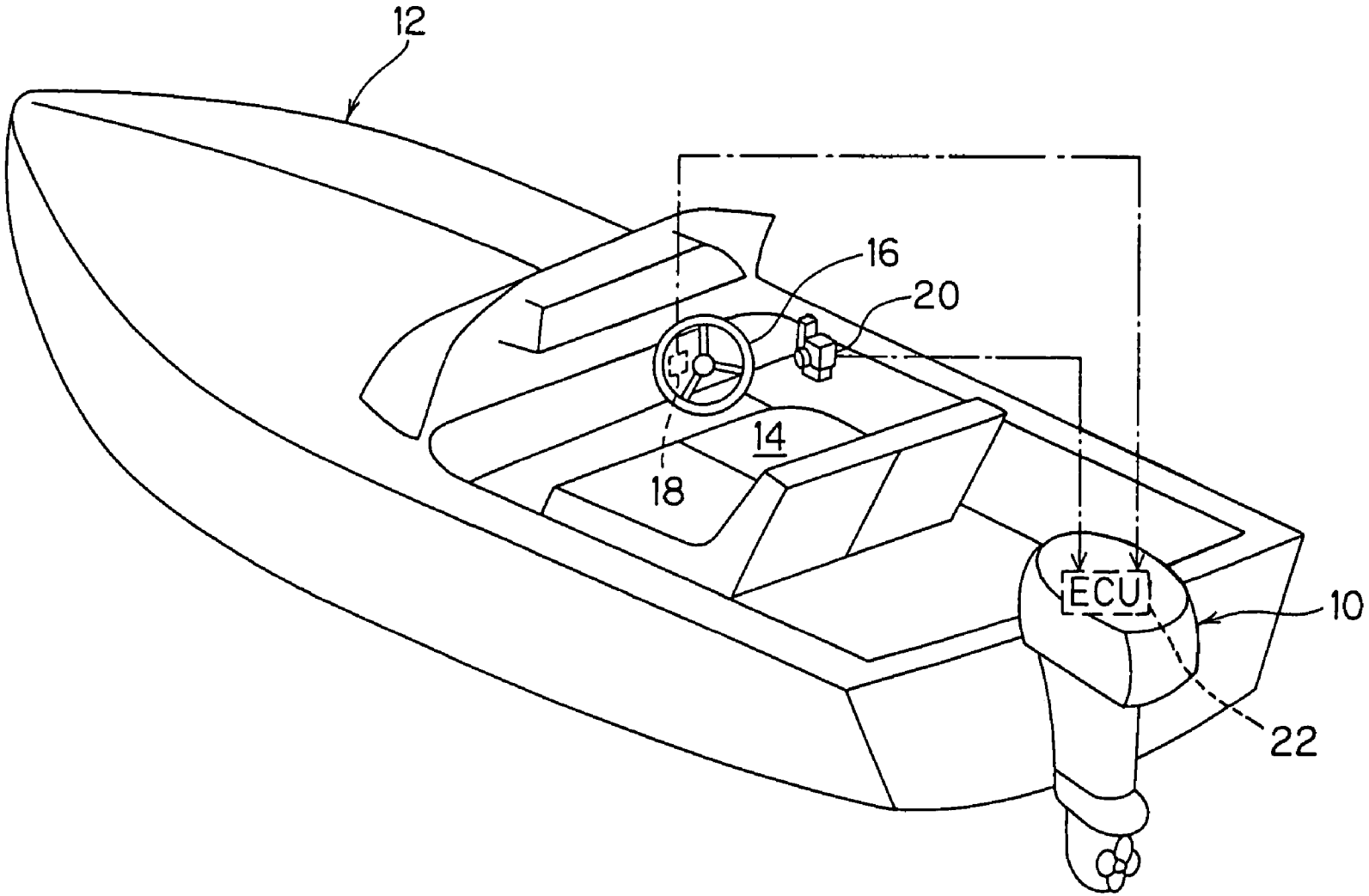
FIG. 1 is an overall schematic view of a remote operation system for an outboard motor including a boat according to a first embodiment of the invention.

FIG. 1 is an overall schematic view of a remote operation system for an outboard motor including a boat according to a first embodiment of the invention.

In FIG. 1, the symbol 10 indicates an outboard motor. As shown in the figure, the outboard motor 10 is mounted on the stern (transom) of a hull (boat) 12.

A cockpit or operator's seat 14 on which the operator sits is prepared on the boat 12 and a steering wheel 16 is installed at the cockpit 14. A steering wheel angle sensor 18 is installed near a shaft (not shown) of the steering wheel 16 and outputs or generates a signal indicative of the rotation angle (manipulated variable) of the steering wheel 16 manipulated by the operator.

A remote control box 20 that remotely controls the operation of the outboard motor 10 is installed at a location apart from the outboard motor 10, specifically at an instrument panel disposed on the right of the steering wheel 16 at the cockpit 14. More specifically, the remote control box 20 is installed on the right side of the cockpit 14. The remote control box 20 includes a lever and switches (explained later) and outputs or generates signals in response to the manipulation of the operator.

An electronic control unit (hereinafter referred to as "ECU") 22 is mounted or installed on the outboard motor 10. The ECU 22 comprises a microcomputer and is inputted with outputs from the steering wheel angle sensor 18 and remote control box 20.

Figure 2:
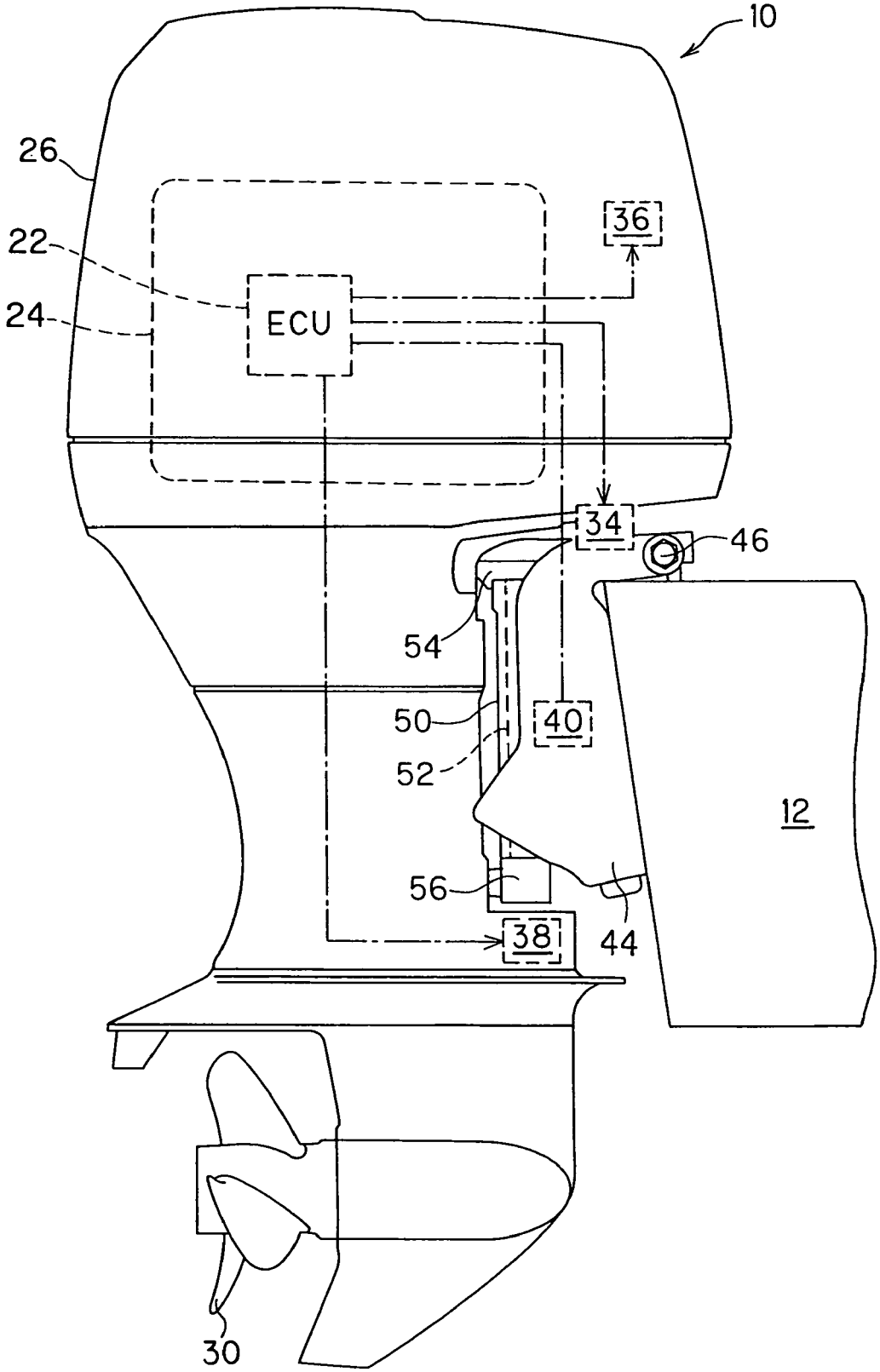
FIG. 2 is a schematic view of the outboard motor shown in FIG. 1.

FIG. 2 is a schematic view of the outboard motor 10.

As shown in FIG. 2, the outboard motor 10 is equipped with an internal combustion engine (hereinafter referred to as "engine") 24 at its upper portion. The engine 24 is a spark-ignition gasoline engine. The engine 24 is located above the water surface and enclosed by an engine cover 26. The ECU 22 is installed inside the engine cover 26 at a location near the engine 24.

The outboard motor 10 is equipped at its lower portion with a propeller 30. The propeller 30 is powered by the engine 24 to operate to propel the boat 12 in the forward and reverse directions.

The outboard motor 10 is further equipped with an electric steering motor (steering actuator) 34 for steering the outboard motor 10 to the right and left directions, an electric throttle motor (throttle actuator) 36 for opening and closing a throttle valve (not shown in FIG. 2) of the engine 24, an electric shift motor (shift actuator) 38 for operating a clutch of a shift mechanism (not shown in FIG. 2) to conduct a shift change, and a power tilt-trim unit (tilt-trim actuator) 40 for regulating a tilt angle and trim angle of the outboard motor 10.

The ECU 22 is connected to the electric steering motor 34, electric throttle motor 36, electric shift motor 38 and power tilt-trim unit 40 and controls the operations thereof based on the above-mentioned outputs of the steering wheel angle sensor 18 and remote control box 20.

Figure 3:
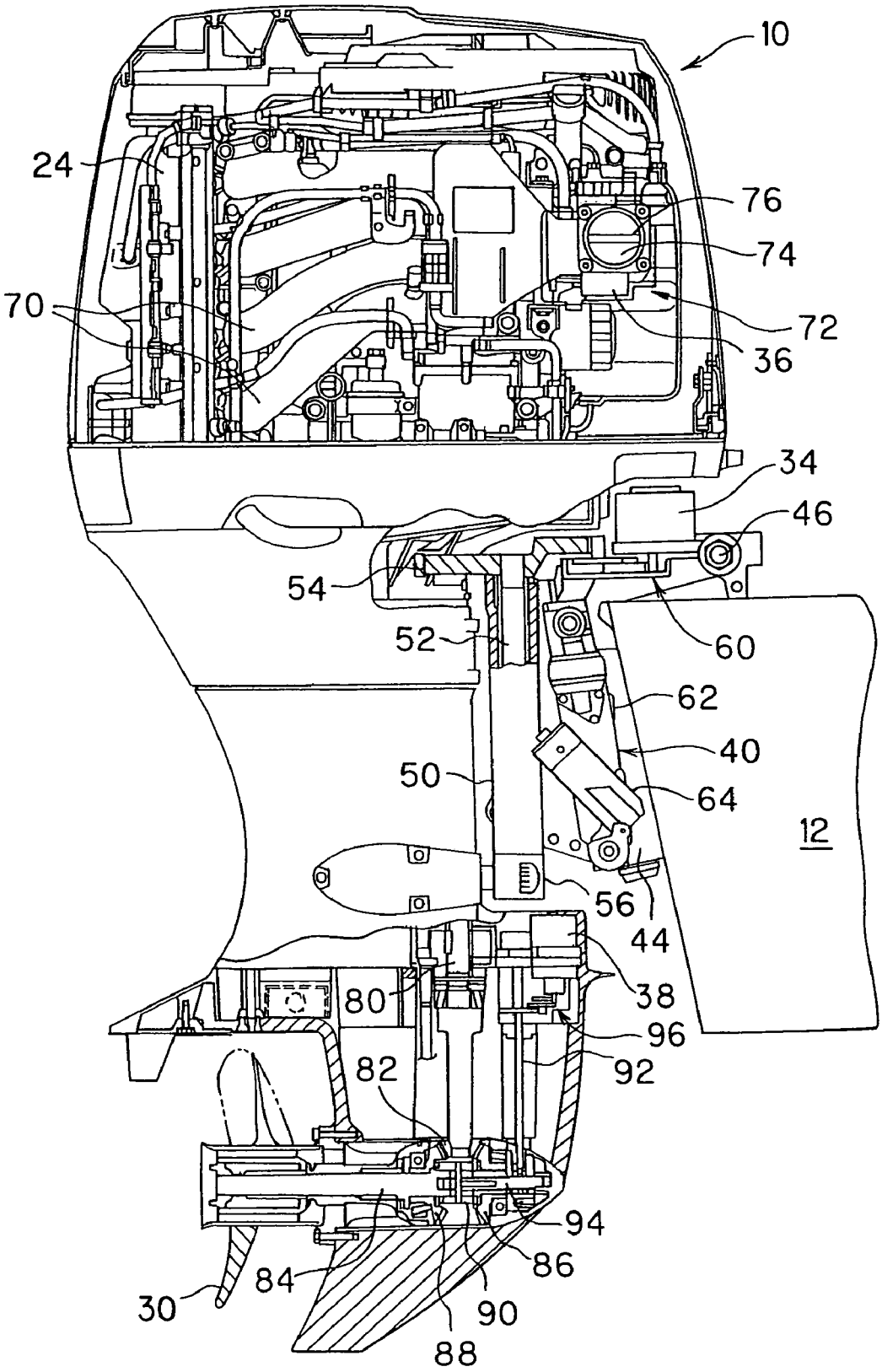
FIG. 3 is a partially sectional view of the outboard motor shown in FIG. 1.

The structure of the outboard motor 10 will now be described in detail with reference to FIG. 3. FIG. 3 is a partial sectional view of the outboard motor 10.

As shown in FIG. 3, the outboard motor 10 is equipped with stern brackets 44 that are fastened to the stern of the boat 12, such that the outboard motor 10 is mounted on the stern of the boat 12 through the stern brackets 44. The stern brackets 44 are comprised of a pair of right and left members that face each other and only the left side thereof in the forward direction is illustrated in FIG. 3.

A swivel case 50 is attached to the stem brackets 44 through a tilting shaft 46. The tilting shaft 46 is placed such that its axial direction is in parallel with a lateral direction (left and right direction perpendicular to the boat forward direction). Specifically, the swivel case 50 is free to rotate about the lateral axis, i.e., the tilting shaft 46, as a rotational axis with respect to the stem brackets 44.

A swivel shaft 52 is housed in a swivel case 50 to be freely rotated about a vertical axis. The upper end of the swivel shaft 52 is fastened to a mount frame 54 and the lower end thereof is fastened to a lower mount center housing 56. The mount frame 54 and lower mount center housing 56 are fastened to a frame constituting a main body of the outboard motor 10.

The upper portion of the swivel case 50 is installed with the electric steering motor 34. The output shaft of the electric steering motor 34 is connected to the mount frame 54 via a speed reduction gear mechanism 60. Specifically, a rotational output generated by driving the electric steering motor 34 is transmitted via the speed reduction gear mechanism 60 to the mount frame 54 such that the outboard motor 10 is steered (rotated) about the swivel shaft 52 as a rotational axis to the right and left directions.

The power tilt-trim unit 40 is installed near the stern brackets 44 and swivel case 50. The unit 40 integrally comprises one hydraulic cylinder for tilt angle regulation (hereinafter called "tilt hydraulic cylinder") 62 and two hydraulic cylinders for trim angle regulation (only one shown in the figure; hereinafter called "trim hydraulic cylinders") 64.

The cylinder bottom of the tilt hydraulic cylinder 62 is fastened to the stem brackets 44 and the rod head thereof abuts on the swivel case 50. The cylinder bottom of each trim hydraulic cylinder 64 is fastened to the stern brackets 44 and the rod head thereof abuts on the swivel case 50. Thus, when the tilt hydraulic cylinder 62 or the trim hydraulic cylinders 64 are driven (extend and contract), the swivel case 50 rotates about the tilting shaft 46 as a rotational axis, thereby driving the outboard motor 10 to perform tilt up/down or trim up/down.

The engine 24 has an intake manifold 70 that is connected to a throttle body 72. A throttle valve 74 is installed at an intake path formed in the throttle body 72. The throttle valve 74 is supported by the throttle body 72 via a throttle shaft 76 to be free to rotate. The electric throttle motor 36 and a speed reduction gear mechanism (not shown) for reducing the output speed of the motor 36 are integrally fastened to the throttle body 72. The throttle shaft 76 is connected to the output shaft of the electric throttle motor 36 via the speed reduction gear mechanism. Specifically, a rotational output generated by driving the electric throttle motor 36 is transmitted to the throttle shaft 76 to open and close the throttle valve 74, thereby regulating an air intake amount to be supplied to the engine 24 to regulate the engine speed.

The outboard motor 10 is equipped with a drive shaft (vertical shaft) 80 that has its rotational axis oriented in parallel with the vertical axis. The upper end of the drive shaft 80 is connected to the crankshaft (not shown) of the engine 24. The lower end of the drive shaft 80 is equipped with a pinion gear 82.

The propeller 30 is attached to a propeller shaft 84 that is free to rotate about a horizontal axis. A forward bevel gear 86 and a reverse bevel gear 88, which mesh with the pinion gear 82 and rotate in the opposite directions from each other, are rotatably supported on the outer circumference of the propeller shaft 84.

A clutch 90 is installed between the forward bevel gear 86 and reverse bevel gear 88 and attached to the propeller shaft 84. By manipulating a shift rod 92 to slide a shift slider 94, the clutch 90 can be brought into engagement with one of the forward bevel gear 86 and the reverse bevel gear 88. The shift mechanism of the outboard motor 10 comprises the clutch 90, shift rod 92 and shift slider 94.

The upper portion of the shift rod 92 is installed with the electric shift motor 38. The output shaft of the electric shift motor 38 is connected to the shift rod 92 via a speed reduction gear mechanism 96. Thus, by driving the electric shift motor 38, the shift rod 92 is rotated to slide the shift slider 94, thereby enabling the clutch 90 to engage with the forward bevel gear 86 or the reverse bevel gear 88.

The rotation of the drive shaft 80 is converted to rotation about the horizontal axis via the pinion gear 82 and bevel gears 86, 88 and transmitted to the propeller shaft 84 via the clutch 90 engaged with one of the bevel gears 86, 88, such that the propeller 30 is rotated either in the direction for propelling the boat 12 forward or the direction for propelling it rearward.

By driving the electric shift motor 38 to slide the shift slider 94 to an appropriate position, the engagement of the clutch 90 and either of the bevel gears 86, 88 can also be released or disengaged. Thus, with the driving of the electric shift motor 38 for operating the clutch 90 of the shift mechanism, the shift position can be controlled to one of the forward position, reverse position and neutral position.

The remote control box 20 that is the unit characterizing the invention will now be explained in detail.

Figure 4:
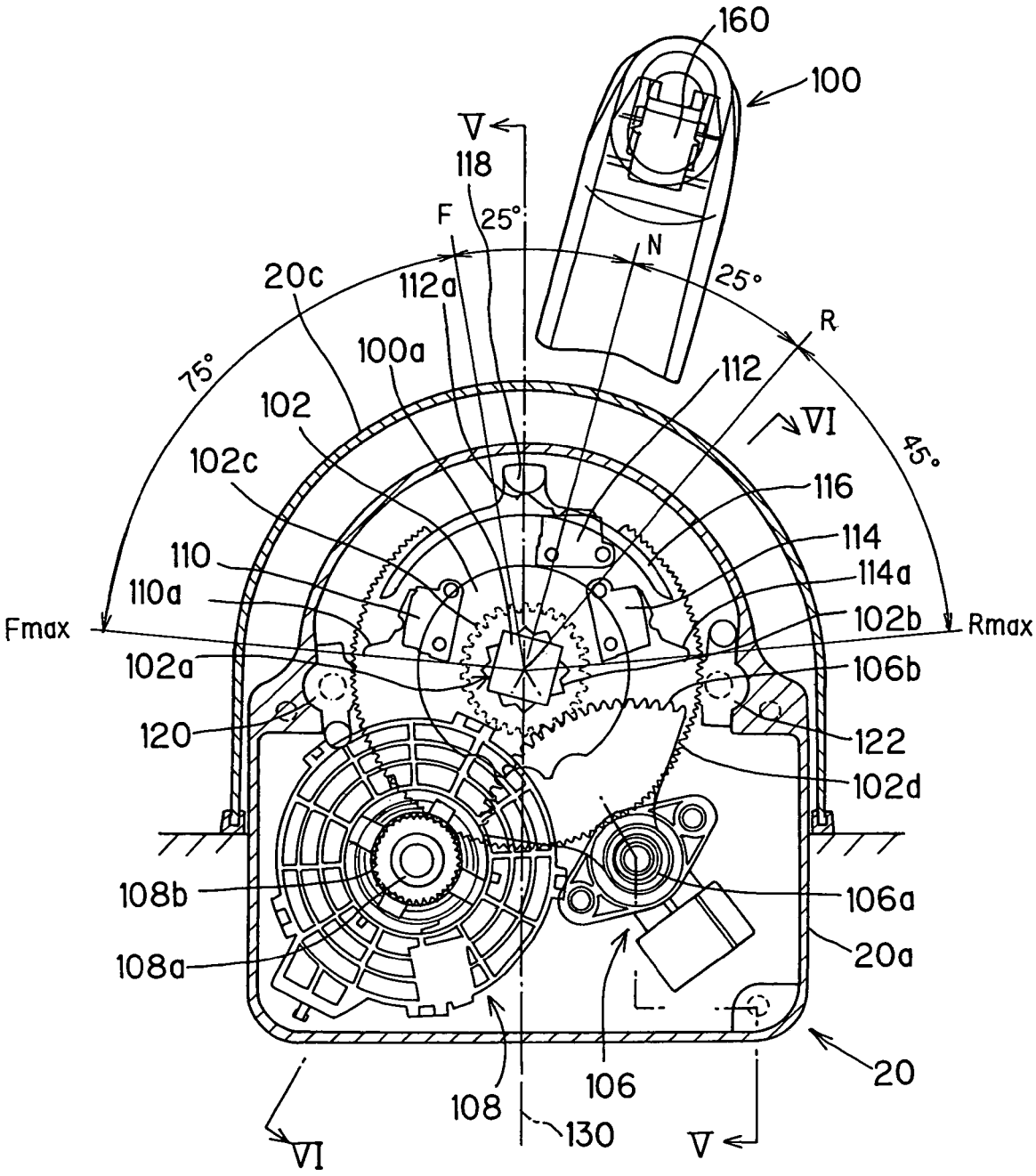
FIG. 4 is an enlarged sectional view of a remote control box.
Figure 5:
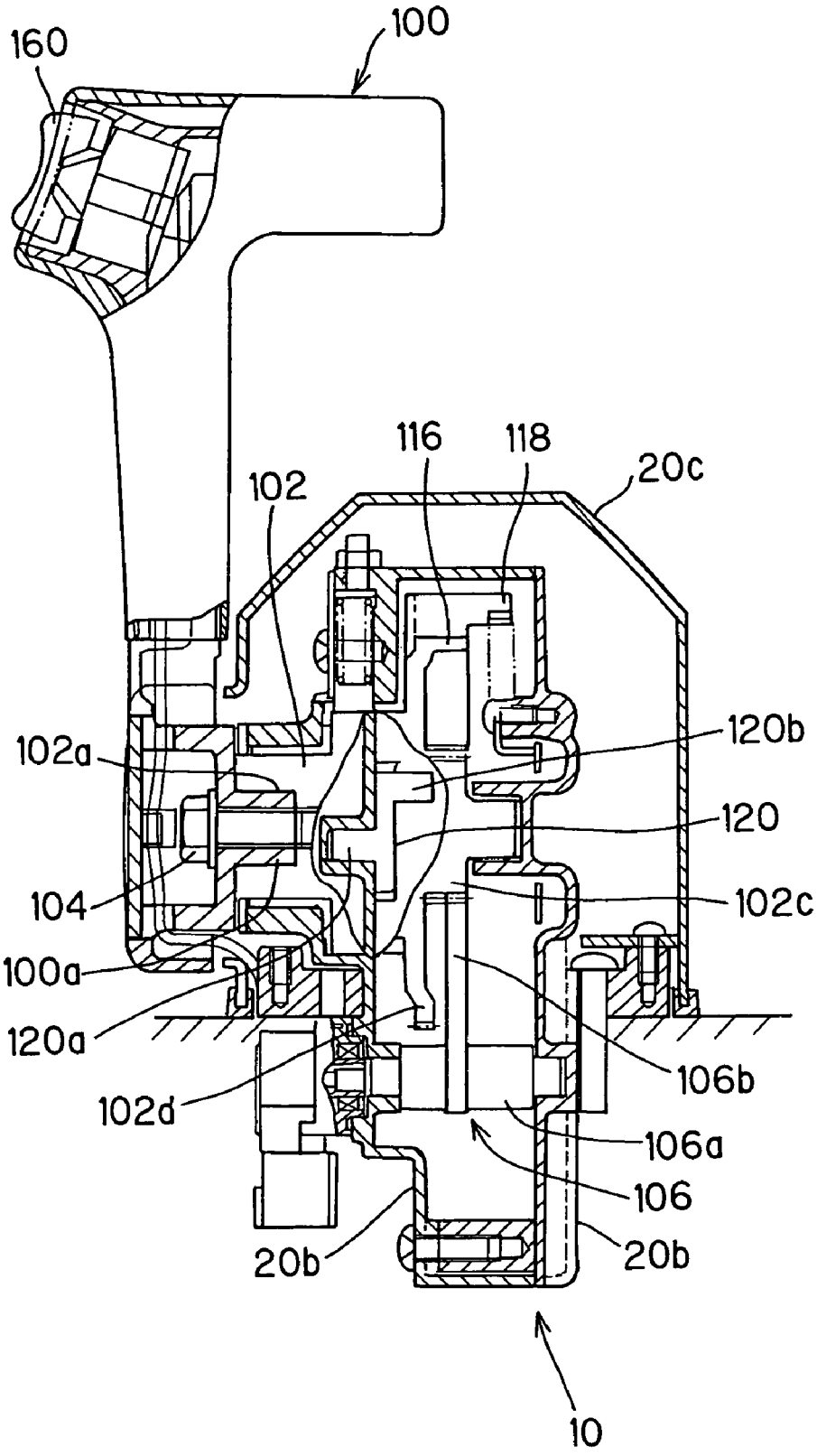
FIG. 5 is a sectional view taken along line V-V in FIG. 4.

FIG. 4 is an enlarged sectional view of the remote control box 20. FIG. 5 is a sectional view taken along line V-V in FIG. 4, and FIG. 6 is a sectional view taken along line VI-VI in FIG. 4.

Figure 6:
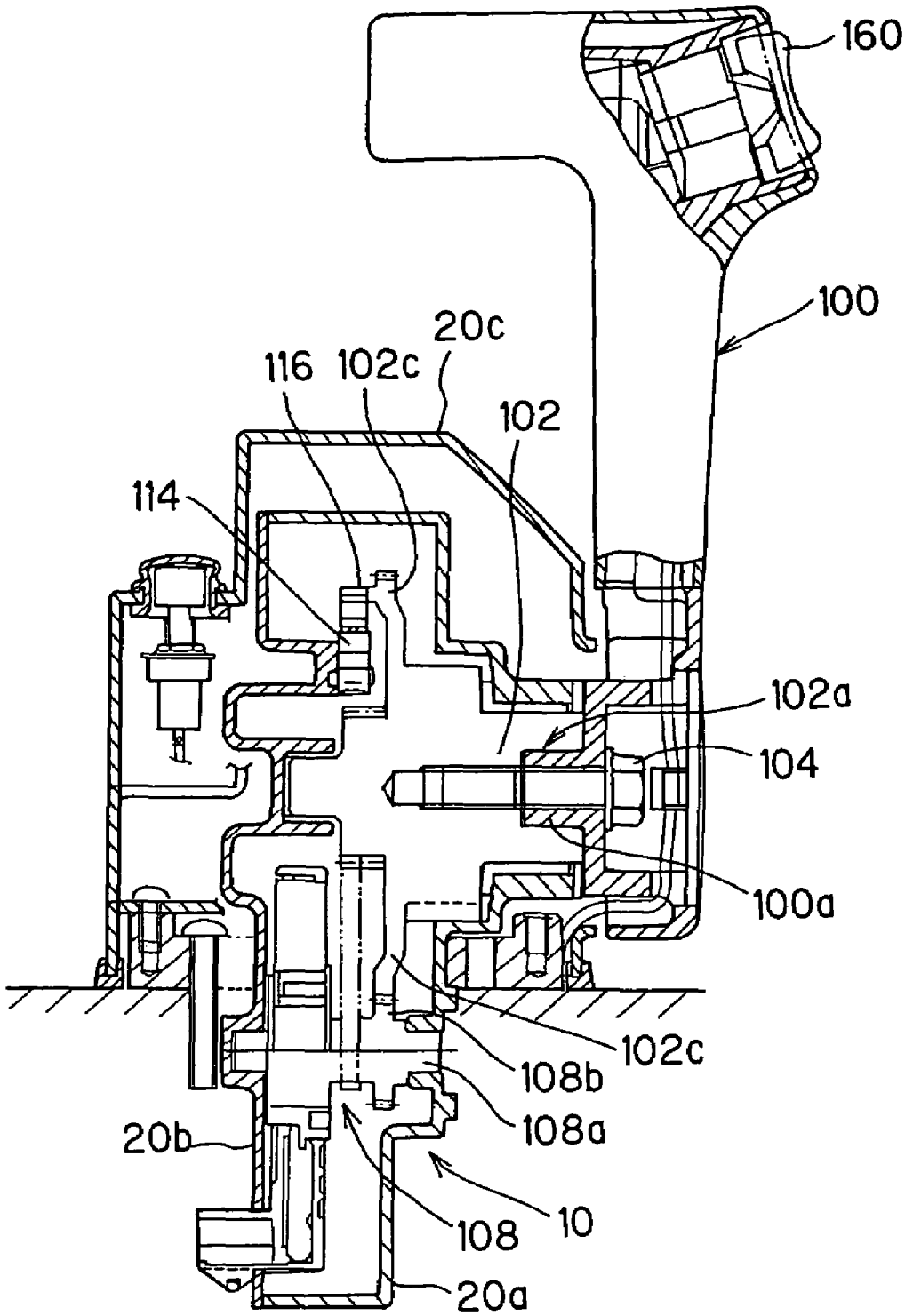
FIG. 6 is a sectional view taken along line VI-VI in FIG. 4.

As shown in FIGS. 4 to 6, the remote control box 20 comprises a case body 20*a* and a lid or case cover 20*b* that is attached to the case body 20*a* to define a space for housing the various components explained in the following. The case body 20*a* and lid 20*b* are further enclosed by a cover 20*c*. The case of the remote control box 20 is constituted by the case body 20*a*, lid 20*b* and cover 20*c*.

The remote control box 20 is equipped with a lever 100 that is attached to a support shaft 102 rotatably accommodated inside the remote control box 20. The lever 100 is thus supported in the remote control box 20 by the support shaft 102 so as to be capable of manipulation (rotation), in other words, the lever 100 is attached to the support shaft 102 that is rotatably accommodated in the remote control box 20 in response to manipulation of the operator.

A concrete explanation will now be given regarding the connection between the support shaft 102 and the lever 100.

The support shaft 102 is formed with a hole 102*a* concentric with its axis of rotation. The wall of the hole 102*a* is formed with a plurality, namely 12, indentations 102*b* spaced at 30 degree intervals. Each of the indentations 102*b* has an internal angle of 90 degrees.

A projection 100*a* formed as a cube or rectangular parallelepiped is provided on a side face of the lever 100 near its lower end. The projection 100*a* is inserted into the hole 102*a* with the sides thereof fitted into some of indentations 102*b*. After the positional relationship between the lever 100 and support shaft 102 has been so established, the lever 100 and support shaft 102 are fastened together by a bolt 104. The angle of attachment of the lever 100 with respect to the support shaft 102 can therefore be changed in increments of the intervals between the indentations 102*b*, i.e., in increments of 30 degrees.

The remote control box. 20 is further equipped with a potentiometer (analog sensor) 106 and a rotary encoder (digital sensor) 108. The potentiometer 106 has an input shaft 106*a* fitted with a sector gear 106*b*. The rotary encoder 108 has an input shaft 108*a* fitted with a gear 108*b*.

A first gear 102*c* is formed on the support shaft 102 to mesh with the gear 106*b* provided on the input shaft of the potentiometer 106. The first gear 102*c* is formed smaller in diameter than the gear 106*b*. As a result, the rotation of the support shaft 102 is reduced in speed by the first gear 102*c* and gear 106*b* and transmitted to the input shaft 106*a* of the potentiometer.

A second gear 102*d* is further formed on the support shaft 102 to mesh with the gear 108*b* provided on the input shaft of the rotary encoder 108. The second gear 102*d* is formed larger in diameter than the gear 108*b*. As a result, the rotation of the support shaft 102 is increased in speed by the second gear 102*d* and gear 108*b* and transmitted to the input shaft 108*a* of the rotary encoder 108.

The potentiometer 106 outputs or generates an analog signal proportional to the angle of geared-down rotation of the support shaft 102 through the lever manupulation (i.e., the manipulation angle of the lever 100). The rotary encoder 108 outputs or generates a digital signal proportional to the angle of geared-up rotation of the support shaft 102 (i.e., the manipulation angle of the lever 100). The outputs of the potentiometer 106 and rotary encoder 108 are sent to the EICU 22. The remote control box 20 is thus equipped with a plurality of (two) sensors that output signals proportional to the manipulation angle of the lever 100.

Figure 7:
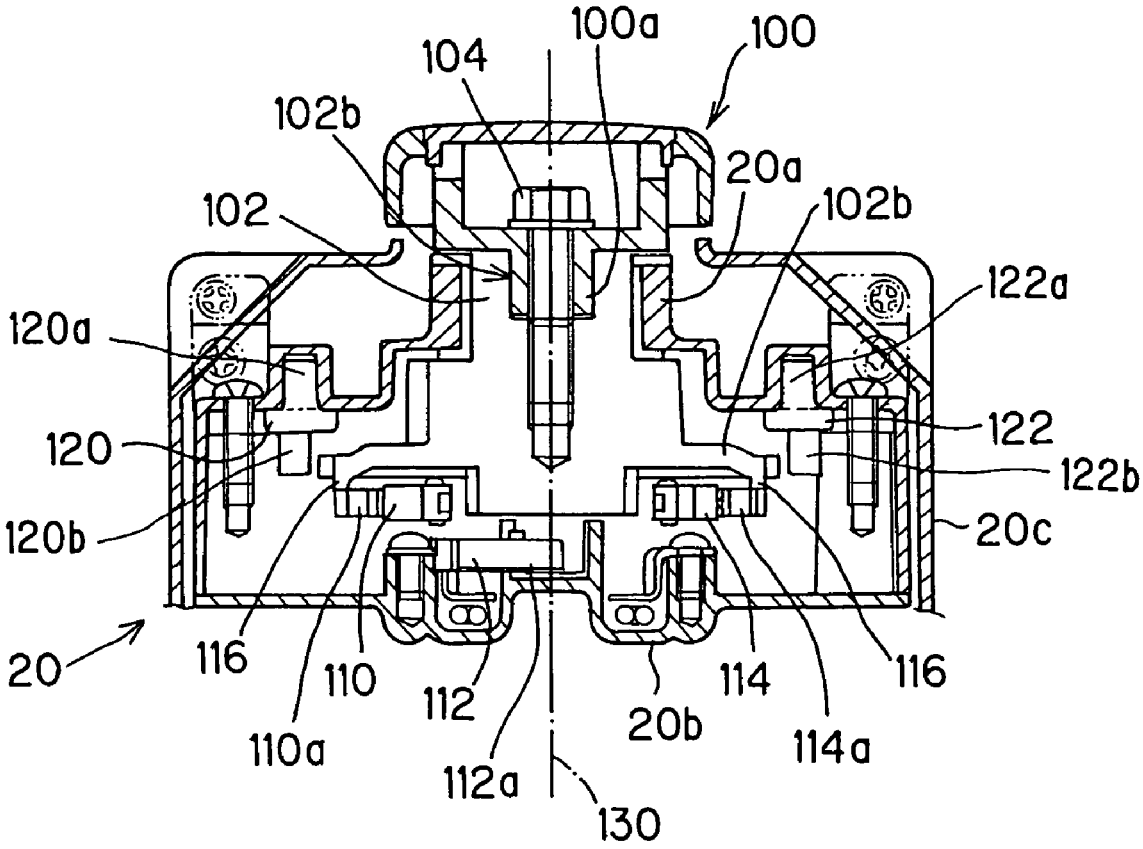
FIG. 7 is a partial sectional view of the remote control box shown in FIG. 4 seen from above a second gear.

FIG. 7 is a partial sectional view of the remote control box 20 seen from above the second gear 102*d*.

As shown in FIGS. 4 to 7, the remote control box 20 is equipped with a plurality of (three) position switches, namely, a forward switch 110, neutral switch 112 and reverse switch 114. The switches 110, 112 and 114 are located on the outer periphery of the support shaft 102 and output or generate signals indicative of the direction of rotation of the support shaft 102 (i.e., manipulation direction of the lever 100).

The contacts of the forward switch 110 and reverse switch 114 are opened and closed by an arcuate switch presser 116 provided on the outer periphery of the support shaft 102 (more exactly, the side of the second gear 102*d*). The contacts of the neutral switch 112 are opened and closed by a projection 118 formed at the middle of the switch presser 116.

To be more specific, the neutral switch 112 outputs an ON signal when its contacts are closed owing to depression of its switch member 112*a* by the projection 118 (i.e. when the lever 100 has been manipulated to position the projection 118 above the switch member 112*a* of the neutral switch 112). The ON signal outputted by the neutral switch 112 is sent to the ECU 22 as a signal indicating that the lever 100 is in neutral position.

The forward switch 110 outputs an ON signal when its contacts are closed owing to depression of its switch member 110*a* by the switch presser 116 (i.e. when the lever 100 has been manipulated to position the switch presser 116 above the switch member 110*a* of the forward switch 110). The ON signal outputted by the forward switch 110 is sent to the ECU 22 as a signal indicating that the lever 100 is manipulated to a position corresponding to the forward position.

The reverse switch 114 outputs an ON signal when its contacts are closed owing to depression of its switch member 114*a* by the switch presser 116 (i.e. when the lever 100 has been manipulated to position the switch presser 116 above the switch member 114*a* of the reverse switch 114). The ON signal outputted by the reverse switch 114 is sent to the ECU 22 as a signal indicating that the lever 100 is in reverse position.

The manipulation ranges of the lever 100 over which the switches 110, 112 and 114 output ON signals will now be explained with reference to FIG. 4.

As shown in FIG. 4, the position of the lever 100 when it is inclined from vertical by a certain angle is defined as the center position (this position being defined as the initial position). Then, when the lever 100 is manipulated within the range of from 25 degrees leftward to 25 degrees rightward from the initial position in the drawing sheet, the neutral switch 112 outputs an ON signal. In other words, a manipulation range (angle) of ±25 degrees from the initial position is defined as the neutral position of the lever 100.

The initial position of the lever 100 can be set as desired by changing the indentations 102*b* into which the projection 100*a* is inserted.

When the lever 100 is manipulated beyond 25 degrees leftward from the initial position in the drawing sheet, the forward switch 110 outputs an ON signal. In other words, the manipulation range (angle) beyond 25 degrees leftward from the initial position in the drawing sheet is defined as the forward position of the lever 100. In the following description, the manipulation direction when the lever 100 is moved from the initial position to the forward position is sometimes called the "forward direction."

When the lever 100 is manipulated beyond 25 degrees rightward from the initial position in the drawing sheet, the reverse switch 114 outputs an ON signal. In other words, the manipulation range (angle) beyond 25 degrees rightward from the initial position in the drawing sheet is defined as the reverse position of the lever 100. In the following description, the manipulation direction when the lever 100 is moved from the initial position to the reverse position is sometimes called the "reverse direction." Thus, the forward switch 110, neutral switch 112 and reverse switch 114 generate the signals when the support shaft 102 is rotated to positions corresponding to the forward position, reverse position and neutral position.

The maximum manipulation angle of the lever 100 in the forward direction (i.e., the permissible angle of rotation of the support shaft 102 in the forward direction; designated "Fmax" in the drawing) is defined or determined by a forward stop 120 detachably attached to the remote control box 20. Similarly, the maximum manipulation angle of the lever 100 in the reverse direction (i.e., the permissible angle of rotation of the support shaft 102 in the reverse direction; designated "Rmax" in the drawing) is defined or determined by a reverse stop 122 detachably attached to the remote control box 20.

Figure 8:
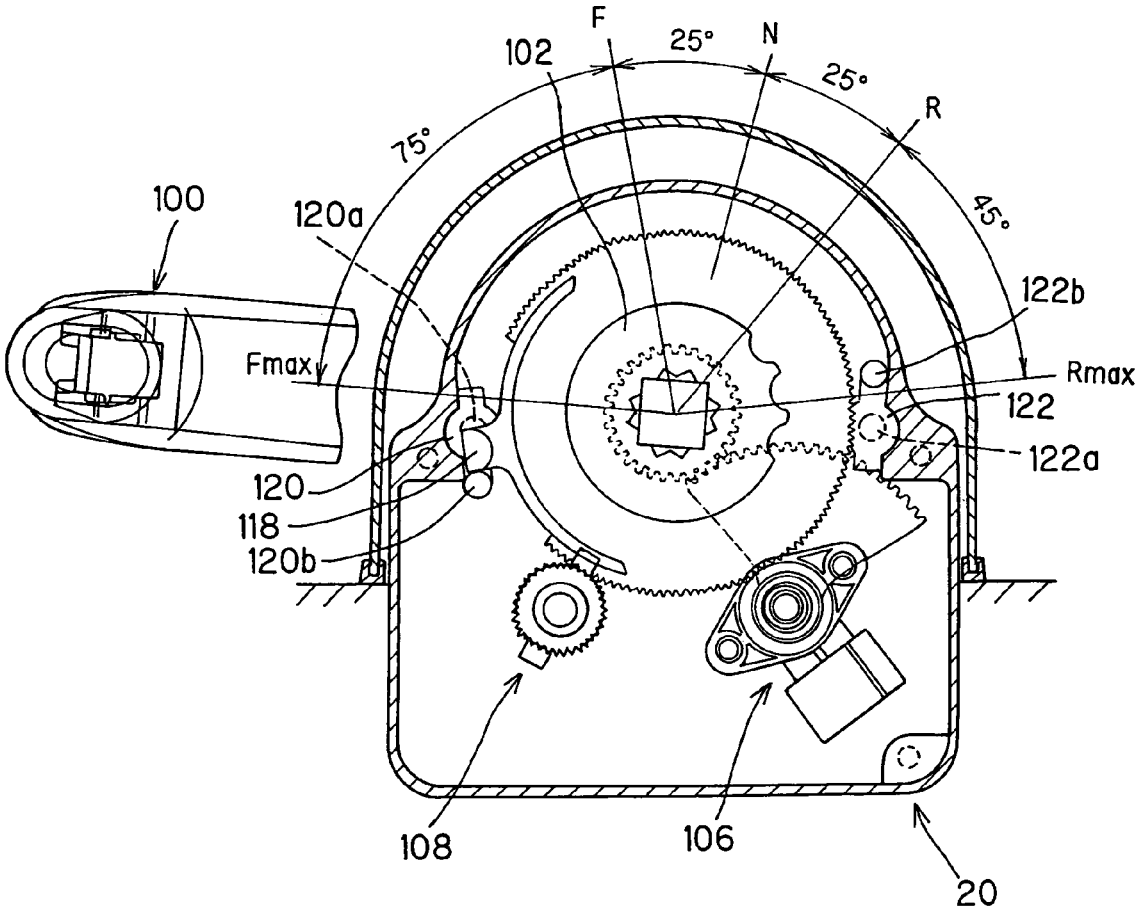
FIG. 8 is an enlarged sectional view of the remote control box similar to FIG. 4.
Figure 9:
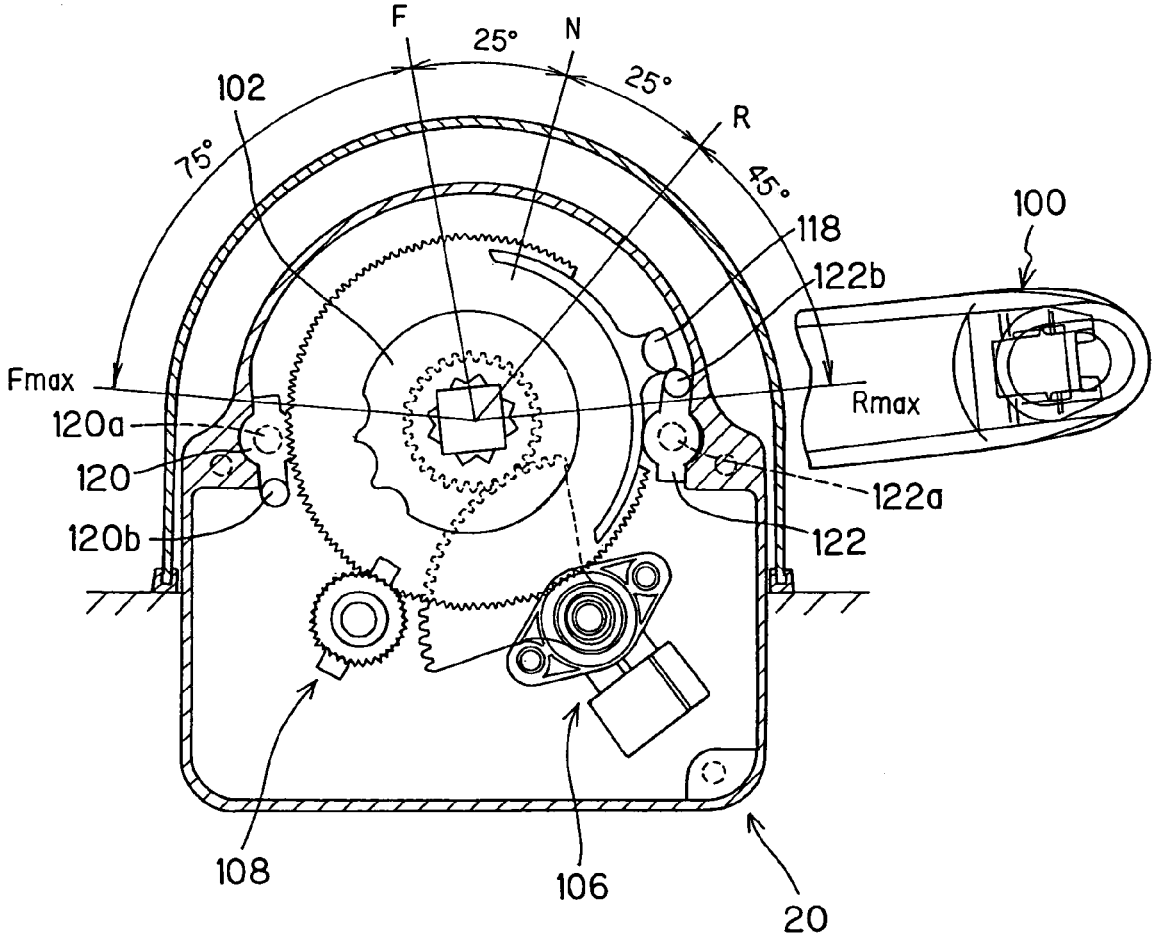
FIG. 9 is an enlarged sectional view of the remote control box similar to FIG. 4.

FIGS. 8 and 9 are enlarged sectional views of the remote control box 20 similar to FIG. 4. However, the position of the lever 100 in FIGS. 8 and 9 is made different from that in FIG. 4. In addition, some components are omitted from FIGS. 8 and 9 for easier visual perception.

As shown in FIGS. 5, 7 and 8, the forward stop 120 is formed roughly in the shape of a crank. The forward stop 120, specifically one end (cylindrical projection) 120*a* thereof, is fitted in a hole portion formed in the remote control box 20, and the other end (also cylindrical projection) 120*b* thereof is situated on the movement locus of the projection 118. Therefore, when the lever 100 is manipulated to the point where the projection 118 formed on the support shaft 102 collides with the other end 120*b* of the forward stop 120, rotation of the support shaft 102 in the forward direction is terminated.

The reverse stop 122 has the same shape as the forward stop 120. That is, it is also formed roughly in the shape of a crank. One end (cylindrical projection) 122*a* thereof is fitted in a hole portion formed in the remote control box 20, and the other end (cylindrical projection) 122*b* thereof is situated on the movement locus of the projection 118. Therefore, when the lever 100 is manipulated to the point where the projection 118 collides with the other end. 122*b* of the reverse stop 122, rotation of the support shaft 102 in the reverse direction is terminated. The movement locus of the projection 118 is positioned upward in the vertical axis (direction) of the other ends 120*b*, 122*b* of the forward stop 120 and reverse stop 122 (i.e., the collision region of projection 118).

As shown in FIGS. 4 and 7, the forward stop 120 and reverse stop 122 are symmetrically positioned with respect to a plane 130 containing the central axis of the support shaft 102. More precisely, the plane 130 is a plane containing the central axis of the support shaft 102 and lying parallel to the vertical axis (direction).

As illustrated in FIGS. 8 and 9, the forward stop 120 and reverse stop 122 are attached to the remote control box 20 to face in different directions. Specifically, the forward stop 120 is attached to the remote control box 20 in such orientation (i.e., first location) that its one end 120*a* is located above the other end 120*b* in the vertical direction, while the reverse stop 122 is attached in such orientation (i.e., second location) that its one end 122*a* is located below the other end 122*b* in the vertical direction. Thus, the other end 120*b* of the forward stop 120 is located below the other end 122*b* of the reverse stop 122 in the vertical direction.

As a result, the range over which the projection 118 can move is larger in the forward direction than the reverse direction, so that the maximum manipulation angle of the lever 100 is greater in the forward direction than in the reverse direction. In this embodiment, the maximum manipulation angle in the forward direction (the manipulation range in the forward position) is defined as 75 degrees and the maximum manipulation angle in the reverse direction (the manipulation range in the reverse position) is defined as 45 degrees.

Moreover, the direction in which the stops 120, 122 are attached to the remote control box 20 can be changed. As a result, the positions (heights) of the other ends 120*b*, 122*b* of the stops 120, 122 can be changed to change the maximum manipulation angle of the lever 100.

Figure 10:
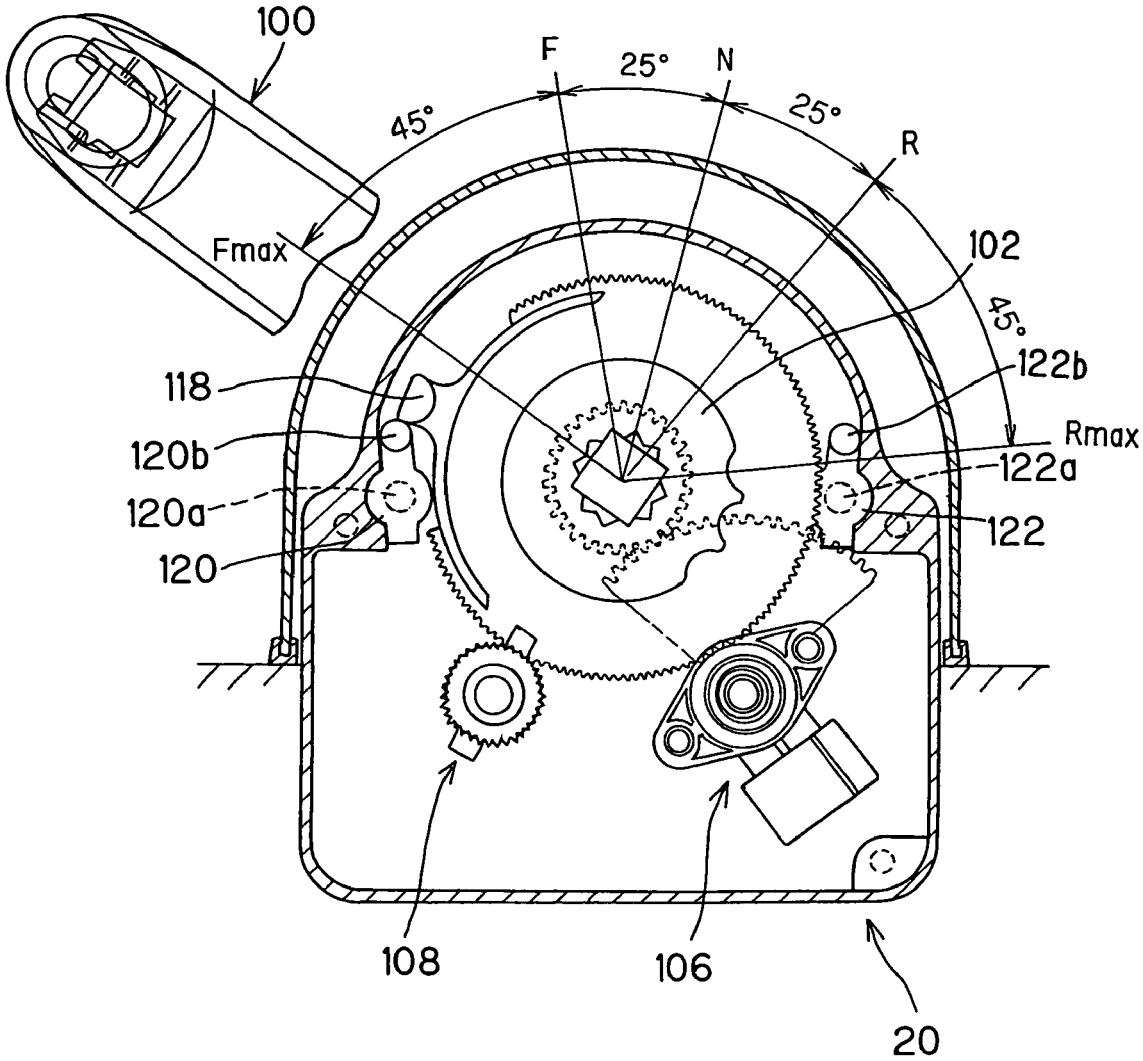
FIG. 10 is an enlarged sectional view of the remote control box similar to FIG. 8.
Figure 11:
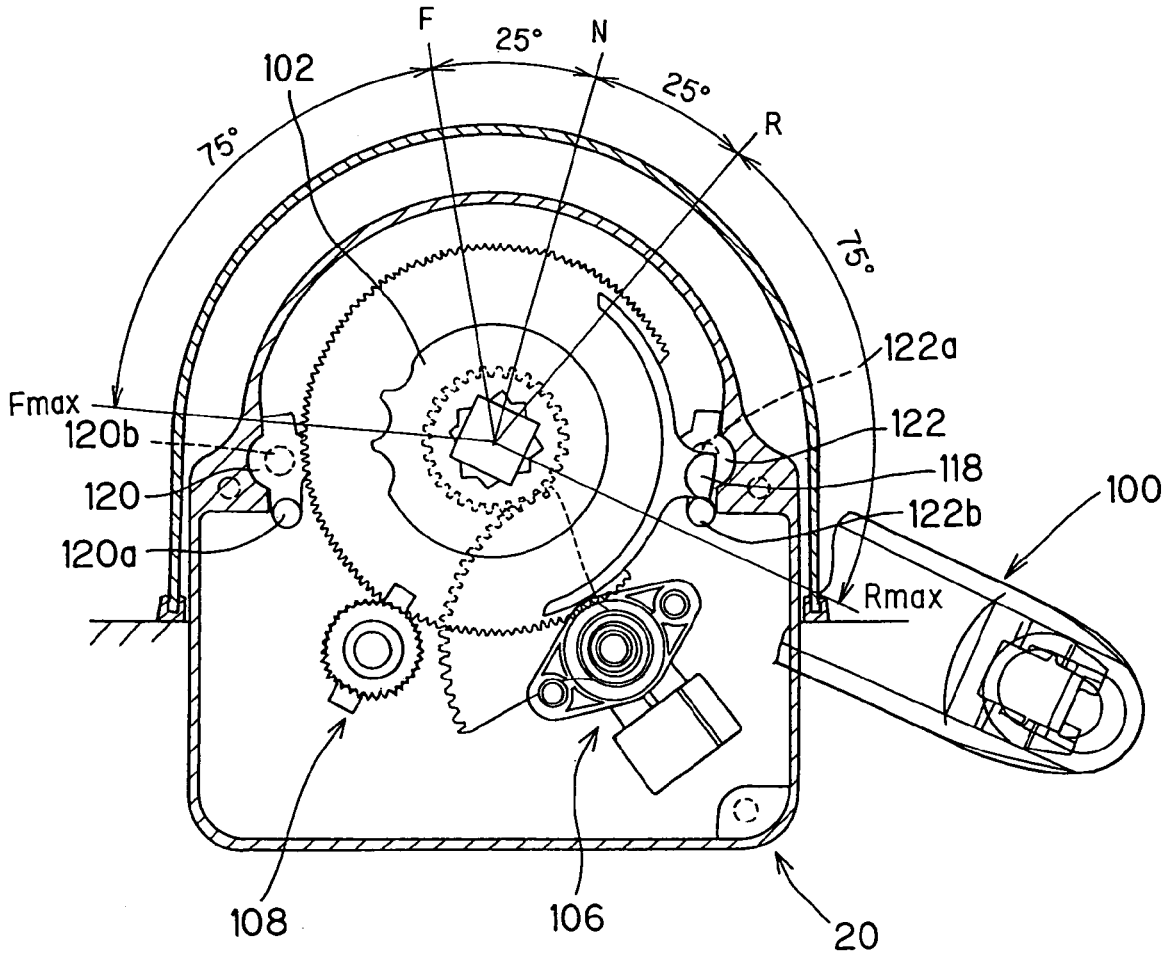
FIG. 11 is an enlarged sectional view of the remote control box similar to FIG. 9.

FIG. 10 is an enlarged sectional view of the remote control box 20 similar to FIG. 8, and FIG. 11 is an enlarged sectional view of the remote control box 20 similar to FIG. 9.

As shown in FIG. 10, if the forward stop 120 is attached so that its other end 120*b* is positioned above its one end 120*a* in the vertical direction (i.e., if the forward stop 120 is attached as rotated 180 degrees in the vertical direction), the range within which the projection 118 can rotate in the forward direction can be reduced, thereby reducing the maximum manipulation angle of the lever 100 in the forward direction.

As shown in FIG. 11, if the reverse stop 122 is attached so that its other end 122*b* is positioned below its one end 122*a* in the vertical direction (i.e., if the reverse stop 122 is attached as rotated 180 degrees in the vertical direction), the range within which the projection 118 can rotate can be increased, thereby increasing the maximum manipulation angle of the lever 100 in the reverse direction.

Further, stops having a different shape from and interchangeable with the stops 120, 122 are additionally provided for the remote control box 20.

Figure 12:
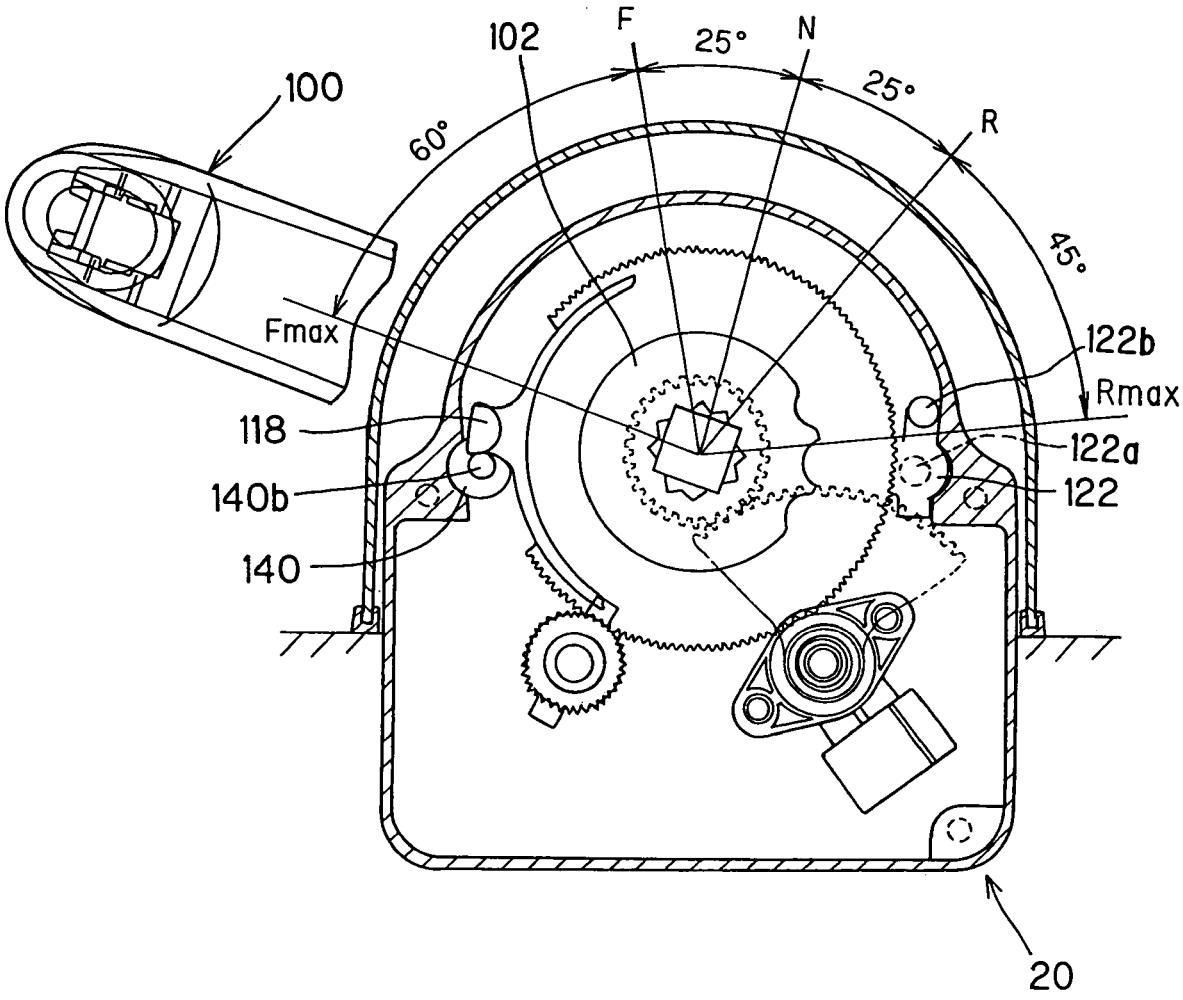
FIG. 12 is an enlarged sectional view of the remote control box similar to FIG. 8.
Figure 13:
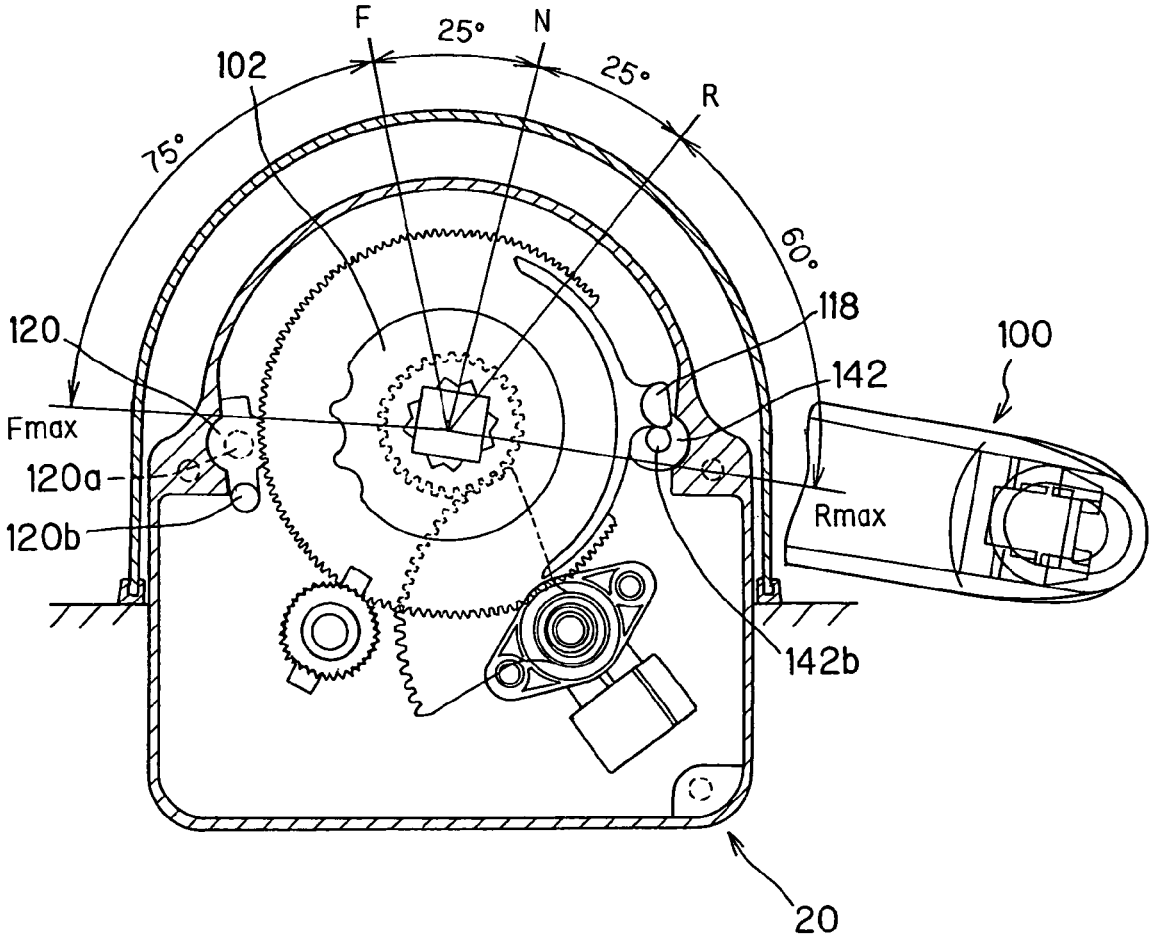
FIG. 13 is an enlarged sectional view of the remote control box similar to FIG. 9.

FIG. 12 is an enlarged sectional view of the remote control box 20 similar to FIG. 8. FIG. 13 is an enlarged sectional view of the remote control box 20 similar to FIG. 9.

In the configuration shown in FIG. 12, the remote control box 20 is provided with a second forward stop 140 having a different shape from the forward stop 120. One end (cylindrical projection; not visible in the drawing) of the second forward stop 140 to be fitted in a hole portion formed in the remote control box 20 and the other end 140*b* (cylindrical projection) thereof to be situated on the movement locus of the projection 118 are disposed on the same straight line. Thus, the forward stop 120 and second forward stop 140 differ in the positional relationship between their one and other ends. In other words, the forward stop 120 and second forward stop 140 differ in the location (height) of the region at which the projection 118 collides.

Interchanging the forward stop 120 and second forward stop 140 therefore changes the range of movement of projection 118, whereby the maximum manipulation angle of the lever 100 in the forward direction can be changed. In this embodiment, use of the second forward stop 140 sets the maximum manipulation angle in the forward direction to 60 degrees.

In the configuration shown in FIG. 13, the remote control box 20 is provided with a second reverse stop 142 having a different shape from the reverse stop 122. The second reverse stop 142 has the same shape as the second forward stop 140. That is, one end (cylindrical projection; not visible in the drawing) of the second reverse stop 142 to be fitted in a hole portion formed in the remote control box 20 and the other end 142*b* (cylindrical projection) thereof to be situated on the movement locus of the projection 118 are disposed on the same straight line.

Thus, the reverse stop 122 and second reverse stop 142 differ in the positional relationship between their one and other ends. In other words, the reverse stop 122 and second reverse stop 142 differ in the location (height) of the region with which the projection 118 collides. Interchanging the reverse stop 122 and second reverse stop 142 therefore changes the range of movement of projection 118, whereby the maximum manipulation angle of the lever 100 in the reverse direction can be changed. In this embodiment, use of the second reverse stop 142 sets the maximum manipulation angle in the reverse direction to 60 degrees.

The remote control box 20 is further equipped with a presser mechanism for applying frictional force to the support shaft 102 so as to impart a moderate manipulation load to the lever 100.

Figure 14:
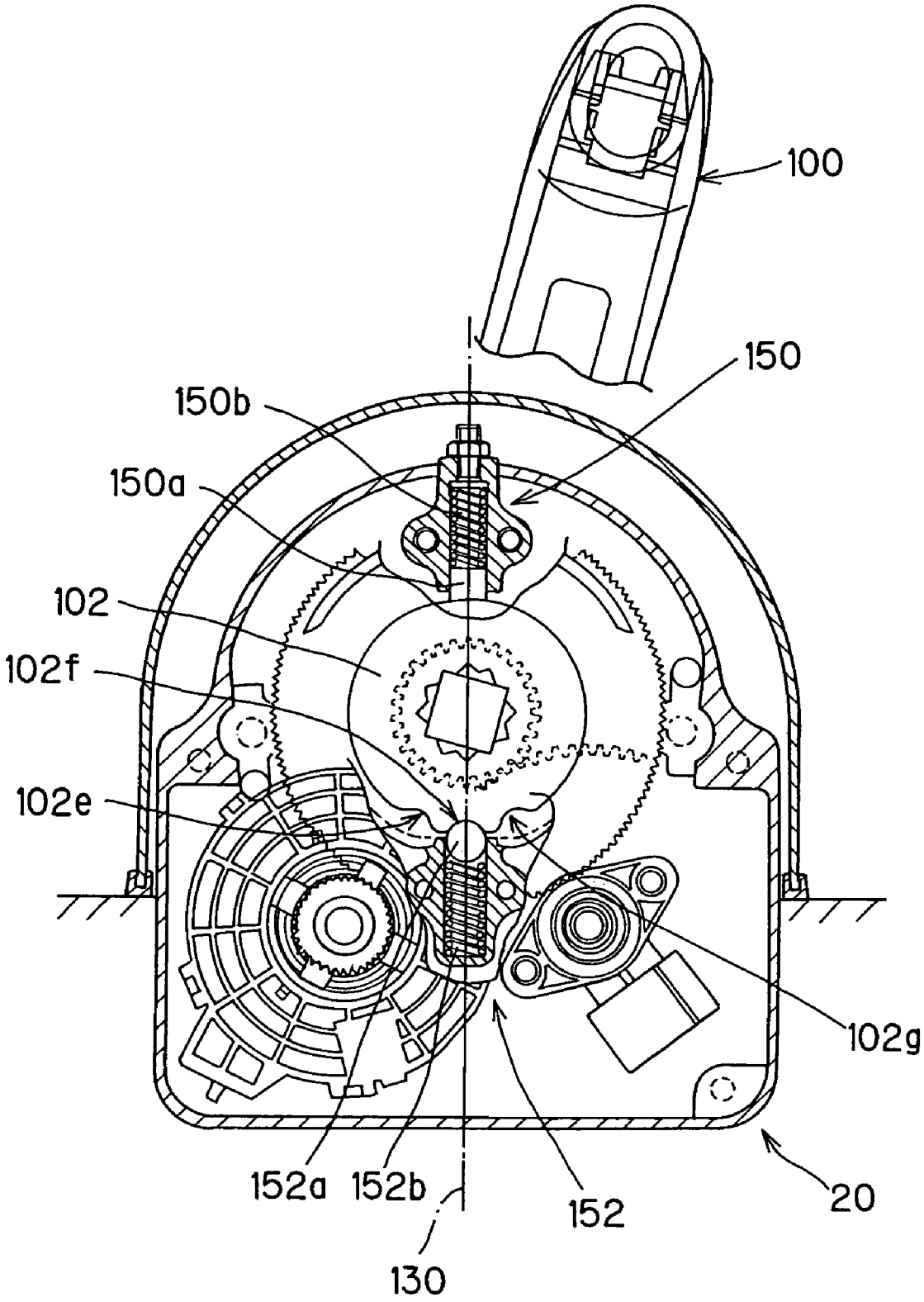
FIG. 14 is an enlarged sectional view of the remote control box similar to FIG. 4.
Figure 15:
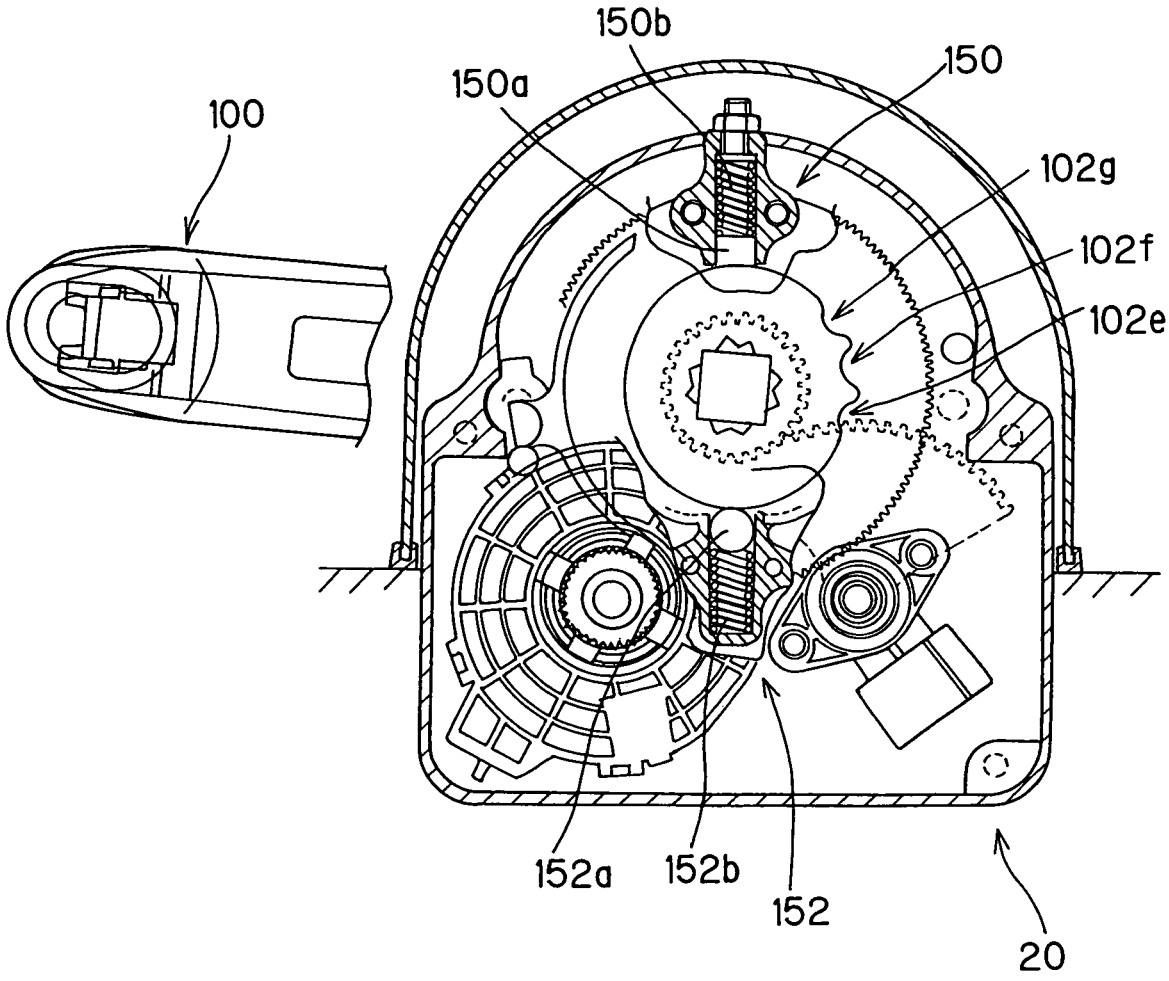
FIG. 15 is an enlarged sectional view of the remote control box similar to FIG. 8.

FIG. 14 is an enlarged sectional view of the remote control box 20 similar to FIG. 4. FIG. 15 is an enlarged sectional view of the remote control box 20 similar to FIG. 8. However, a part of the sectioning plane in FIGS. 14 and 15 is different from that in FIGS. 4 and 8.

Symbols 150 and 152 in FIGS. 14 and 15 designate presser mechanisms. The presser mechanism designated by the symbol 150 will be called the "first presser mechanism" and the presser mechanism designated by the symbol 152 will be called the "second presser mechanism."

The first presser mechanism 150 comprises an abutment member 150*a* that abuts on the outer periphery of the support shaft 102 and an elastic member, specifically a spring 150*b*, that urges the abutment member 150*a* toward the support shaft 102. The abutment member 150*a* is formed of a high-friction material such as rubber.

The second presser mechanism 152 comprises an abutment member 152*a* that abuts on the outer periphery of the support shaft 102 and an elastic member, specifically a spring 152*b*, that urges the abutment member 152*a* toward the support shaft 102. The abutment member 152*a* is formed of metal or the like to have a spherical shape.

The pressing of the abutment members 150*a*, 152*a* of the presser mechanisms onto the peripheral surface of the support shaft 102 in this manner applies frictional force to the support shaft 102, thereby imparting a moderate manipulation load to the lever 100.

The support shaft 102 will be explained in detail.

The support shaft 102 is given an elliptical sectional profile (cam-like shape). As illustrated in FIG. 14, when the lever 100 is in the neutral position, the peripheral surfaces of the elliptical profile of the support shaft 102 at its minor axis ends are abutted on by the abutment members 150*a*, 152*a*. With increasing manipulation angle of the lever 100 in the forward direction or reverse direction, the abutment regions of the abutment members 150*a*, 152*a* move progressively toward the peripheral surfaces at the major axis ends.

The frictional force to be applied to the support shaft 102 therefore varies with rotation angle of the support shaft 102. Specifically, the applied frictional force increases with increasing rotation angle of the support shaft 102. As a result, the manipulation load of the lever 100 increases with increasing manipulation angle.

In addition, the peripheral surface of the support shaft 102 at the minor axis end is formed with three equally spaced indentations 102*e*, 102*f* and 102*g*. The abutment member 152*a* of the second presser mechanism 152 enters the indentations 102*e*, 102*f* and 102*g* in response to the rotation angle of the support shaft 102 (or in response to the manipulation of the lever 100).

Specifically, as shown in FIG. 14, when the lever 100 is in the neutral position, the abutment member 152*a* of the second presser mechanism enters the middle indentation 102*f* When the lever 100 is in the forward position (more exactly, when it makes the transition from the neutral position to the forward position), the abutment member 152*a* enters the indentation 102*e* on the left side in the drawing sheet. When the lever 100 is in the reverse position (more exactly, when it makes the transition from the neutral position to the reverse position), the abutment member 152*a* enters the indentation 102*g* on the right side in the drawing sheet.

Thus when the lever 100 changes position, the abutment member 152*a* of the second presser mechanism snaps into one of the indentations 102*e*, 102*f* and 102*g*, thereby enhancing the operating feel with a clicking sensation.

The explanation with reference to FIGS. 4 to 7 will be resumed.

A power tilt-trim switch 160 is provided on one side face of the lever 100. The power tilt-trim switch 160 is a rocker switch comprising an up-switch and down-switch (When the up-switch is pressed by the operator, it outputs signals corresponding to tilt/trim up instructions inputted by the operator, while when the down-switch is pressed, it outputs signals corresponding to tilt/trim down instructions inputted by the operator.) The output of the power tilt-trim switch 160 is sent to the ECU 22.

As shown in FIGS. 4 and 7, the case body 20*a*, lid 20*b* and cover 20*c* of the remote control box 20 are symmetrical with respect to the plane 130 mentioned above (are laterally symmetrical in the plane of the drawing sheet). Thus the case of the remote control box 20 is symmetrical with respect to the plane 130.

Not only the stops 120, 122 but also the potentiometer 106 and rotary encoder 108 are disposed symmetrically with respect to the plane 130. Further, the forward switch 110 and reverse switch 114 are also disposed symmetrically with respect to the plane 130. In addition, the neutral switch 112 (more exactly, the switch member 112*a* thereof) is disposed with its center line falling in the plane 130. Still further, the first and second presser mechanisms 150, 152 are disposed with their center lines falling in the plane 130.

Thus, it can be seen that the case of the remote control box 20 is formed symmetrically with respect to the plane 130 and that the components accommodated inside the remote control box 20 are also laid out symmetrically with respect to the plane 130.

Figure 16:
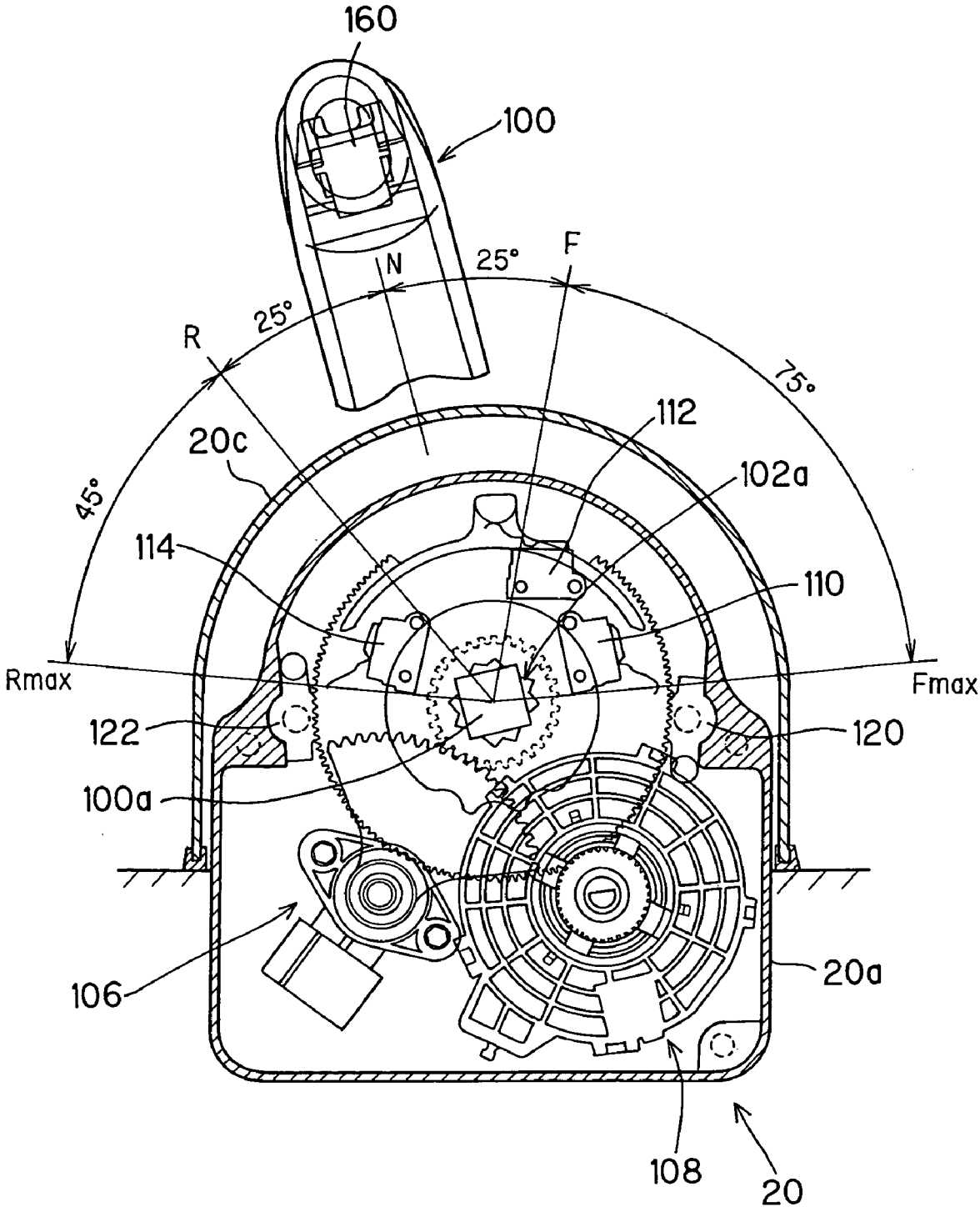
FIG. 16 is an enlarged sectional view similar to FIG. 4 showing a modified version of the remote control box for installation on the left side of the operator.

FIG. 16 is an enlarged sectional view similar to FIG. 4 showing a modified version of the remote control box 20 for installation on the left side of the cockpit 14.

As shown in FIG. 16, when the remote control box 20 is installed on the left side of the cockpit 14 (when the remote control box 20 is turned 180 degrees to face in the opposite direction), the positions of the potentiometer 106 and rotary encoder 108 should be interchanged. And the positions of the forward switch 110 and reverse switch 114 and the positions of the forward stop 120 and reverse stop 122 should also be interchanged. Further, the lever 100 is relocated to a position on the opposite of the plane 130 from that when the remote control box 20 is located on the right side of the operator. If the lever 100 is attached so as to incline 30 degrees to the right of vertical in the drawing sheet when the remote control box 20 is installed on the right side of the cockpit 14, it should be attached to incline 30 degrees to the left of vertical in the drawing sheet when the remote control box 20 is to be installed on the left side of the cockpit 14. By this arrangement, notwithstanding that the remote control box 20 is installed on the left side, the forward direction and reverse direction of the lever 100 remain the same as when it is installed on the right side of the operator and the manipulation range of the lever 100 does not seem unnatural to the operator.

Figure 17:
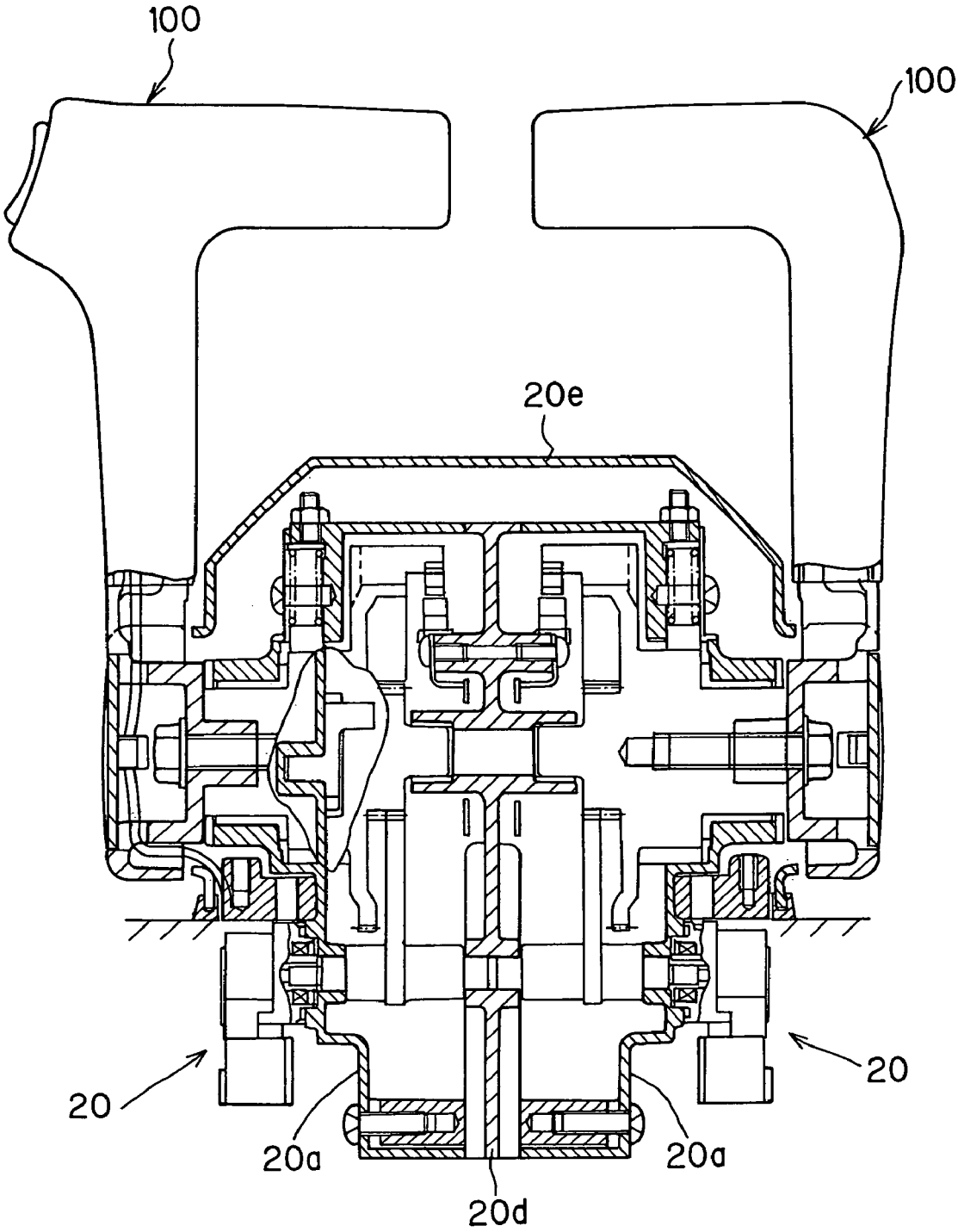
FIG. 17 is an enlarged sectional view showing the remote control box shown in FIG. 4 and that in FIG. 16 that are integrally configured.

Moreover, when two outboard motors are installed in a dual motor configuration, if the remote control box 20 shown in FIG. 4 (right side remote control box) and the remote control box 20 shown in FIG. 16 (left side remote control box) are used in the respective outboard motor operating systems, it then becomes possible to install the remote control boxes 20, 20 to face each other in a compact manner. Further, as shown in FIG. 17, the remote control boxes 20, 20 can be configured to share a common lid and common cover (designated by symbols 20*d* and 20*e*, respectively) to enable integration of the two remote control boxes into a compact unit.

The operation of the remote operation system for an outboard motor according to the first embodiment of the invention will now be explained.

Figure 18:
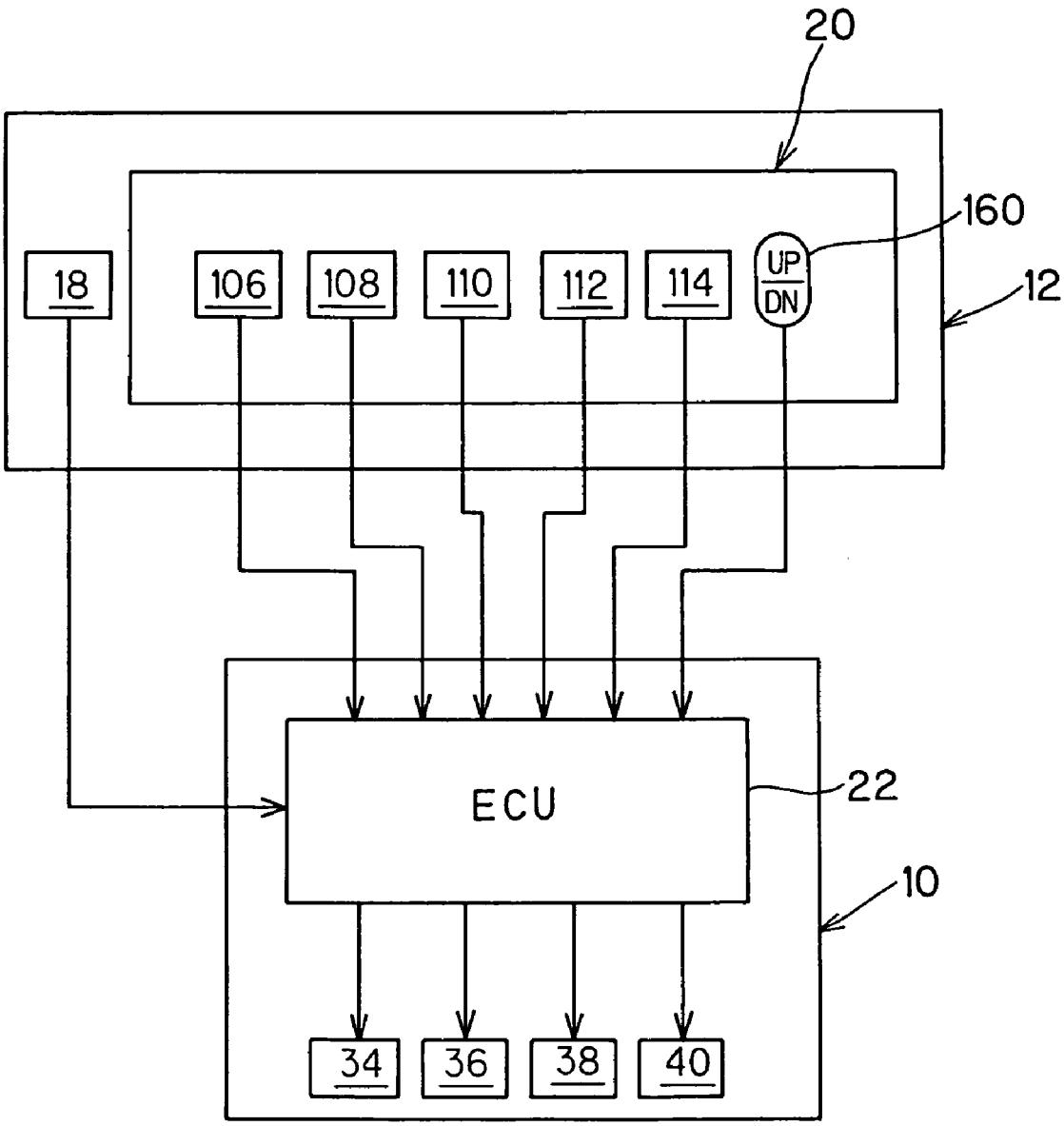
FIG. 18 is a block diagram showing the configuration of the remote operation system for the outboard motor shown in FIG. 1.

FIG. 18 is a block diagram showing the configuration of the remote operation system for an outboard motor according to the first embodiment.

As shown in FIG. 18, the output signal from the steering angle sensor 18 installed on the cockpit 14 of the boat 12 is sent to the ECU 22 incorporated in the outboard motor 10. The output signals from the potentiometer 106, rotary encoder 108, forward switch 110, neutral switch 112, reverse switch 114 and power tilt-trim switch 160 provided in the remote control box 20 are also sent to the ECU 22.

The ECU 22 controls the operation of the electric steering motor 34 based on the output value from the steering angle sensor 18 such that the boat 12 is steered. The ECU 22 further controls the operation of the electric shift motor 38 based on the output values from the forward switch 110, neutral switch 112 and reverse switch 114, such that the shift position of the outboard motor 10 is changed.

In addition, the ECU 22 controls the operation of the electric throttle motor 36 based on the output value from the rotary encoder 108 so as to regulate the throttle opening. More specifically, it controls the operation of the electric throttle motor 36 so as to increase the throttle opening with increasing manipulation angle of the lever 100 detected by the rotary encoder 108. The amount of change in throttle opening relative to the amount of change in the manipulation angle of the lever 100 (change in throttle opening per angular unit) is appropriately determined or set with reference to the maximum manipulation angle of the lever 100, i.e., the type and orientation of the stops.

When any of the rotary encoder 108, forward switch 110, neutral switch 112 and reverse switch 114 malfunctions, the ECU 22 controls the operation of the electric shift motor 38 and electric throttle motor 36 based on the output of the potentiometer 106.

The ECU 22 further controls the operation of the power tilt-trim unit 40 based on the output value from the power tilt-trim switch 160. When the up-switch (designated UP in the drawing) is pressed, the ECU 22 operates the tilt hydraulic cylinder 62 and trim hydraulic cylinder 64 to extend their rods and produce a tilt-up or trim-up action, and when the down-switch (designated DN) is pressed, it operates the tilt hydraulic cylinder 62 and trim hydraulic cylinder 64 to retract their rods and produce a tilt-down or trim-down action.

Although the throttle actuator for opening and closing the throttle valve 74 and the shift actuator for operating the clutch 90 were both exemplified as electric motors in the foregoing description, they can instead be hydraulic cylinders, magnetic solenoids or other such actuators.

It has been explained that the operation of the electric throttle motor 36 and electric shift motor 38 is normally controlled based on the output values of the rotary encoder 108, forward switch 110, neutral switch 112 and reverse switch 114, and that when any of these malfunctions, the operation of the motors 36, 38 is controlled based on the output value of the potentiometer 106. However, the reverse is also possible. In other words, the operation of the motors 36, 38 can be normally controlled based on the output value of the potentiometer 106, and when the potentiometer 106 malfunctions, the operation of the motors 36, 38 can be controlled based on the output values of the rotary encoder 108 and the switches 110, 112 and 114. Moreover, the operation of the motors 36, 38 can at all times be controlled based on all of the output values of the sensors 106 and 108 and the switches 110, 112 and 114.

Malfunction of the sensors 106 and 108 and the switches 110, 112 and 114 can be detected by comparing their output values. For instance, in the case where the potentiometer 106 produces an output value indicating that the lever 100 is in the forward position and the forward switch 110 produces an ON signal but the rotary encoder 108 produces an output value indicating that the outboard motor 10 is in a position other than forward position, it can be concluded that the rotary encoder 108 has malfunctioned.

Although the analog sensor for detecting the manipulation angle of the lever 100 has been exemplified as the potentiometer 106, another type of analog sensor can be used instead. Likewise, the digital sensor for detecting the manipulation angle of the lever 100 need not necessarily be the rotary encoder 108 as explained in the foregoing but can be any of various other types of digital sensors.

In the remote operation system for an outboard motor of the foregoing embodiment, the rotation of the support shaft 102 of the lever 100 provided in the remote control box 20 is increased in speed by the second gear 102*d* and is transmitted to the rotary encoder 108. Change in the manipulation angle of the lever 100 can therefore be more finely detected. Moreover, the reliability of the detection value is increased because the digital signal outputted by the rotary encoder 108 is less susceptible to disturbances or noises.

The rotation angle of the support shaft 102 is detected using the potentiometer 106 and rotary encoder 108, and the operation of the electric throttle motor 36 and electric shift motor 38 is controlled based on at least one output value obtained by detecting the rotation direction of the support shaft 102 using the three switches 110, 112 and 114. In other words, the sensorory system is imparted with redundancy by combined use of a digital sensor and an analogy sensor. Therefore, even if any of the sensors or switches should malfunction, control of the motors 36, 38 can still be continued based on the output values of the remaining sensor and/or switch(es), thereby enhancing the reliability of the system.

To go into the details, the operation of the motors 36, 38 is controlled based either on the combined output values of the rotary encoder 108 and the three switches 110, 112 and 114 or on the output value of the potentiometer 106. Thus two sensory systems, one analog and one digital, are established, which improves the reliability of the system because when one sensory system fails, the operation of the motors 36, 38 can be continued based on the output value of the other sensorory system. Of particularly note is that the switches 110, 112 and 114 are provided in addition to the potentiometer 106 and rotary encoder 108 for detecting the rotation direction of the support shaft 102, whereby throttle opening regulation and shift position change can be effectively prevented from being failed simultaneously.

The first gear 102*c* and second gear 102*d* are provided on the support shaft 102 and used to drive the input shaft 106*a* of the potentiometer and the input shaft 108*a* of the rotary encoder. Since this means that the input shafts 106*a*, 108*a* are driven by the same shaft (support shaft 102), occurrence of error in the outputs of the sensors can be prevented.

The case of the remote control box 20 (the case body 20*a*, lid 20*b* and cover 20*c*) is formed to be symmetrical with respect to the plane 130 containing the axis of the support shaft 102, and a plurality of sensors 106, 108, a plurality of switches 110, 112, 114, and a plurality of stops 120, 122 are each arranged therein to be symmetrical with respect to the plane 130. Owing to this configuration, a common remote control box can be used for installation on right side of the cockpit 14 (the remote control box 20 shown in FIG. 4) and for installation on the left side of the cockpit 14 (the remote control box 20 shown in FIG. 16). As a result, the remote control box 20 can be reduced in number of components and improved in assembly efficiency. Moreover, when two outboard motors 10 are installed in a dual motor configuration, if the remote control box 20 shown in FIG. 4 and the remote control box 20 shown in FIG. 16 are used in the respective outboard motor operating systems, it then becomes possible to install the remote control boxes in a compact face-to-face configuration.

The remote control box 20 is equipped with the first presser mechanism 150 comprising the abutment member 150*a* for abutting on the outer periphery of the support shaft 102 and the spring 150*b* for urging the abutment member 150*a* toward the support shaft 102 and with the second presser mechanism 152 comprising the abutment member 152*a* for abutting on the outer periphery of the support shaft 102 and the spring 152*b* for urging the abutment member 152*a* toward the support shaft 102. The support shaft 102 can therefore be imparted with frictional force that imparts a moderate manipulation load to the lever 100, thereby enhancing the operating feel.

The support shaft 102 is given an elliptical (cam-like) sectional profile that enables the frictional force applied to the support shaft 102 to be varied with rotation angle. In other words, the manipulation load of the lever 100 is made to vary with the change in the manipulation angle (i.e., change in throttle opening), so that the operator can judge the throttle opening from the lever operating feel. Of particular note is that the frictional force is made to increase with increasing manipulation angle of the lever 100 (i.e., the manipulation load of the lever 100 is made to increase with increasing throttle opening), so that erroneous operation of the lever 100 can be prevented during high-speed cruising (large throttle opening), when the motion of the boat tends to be particularly unsteady.

The support shaft 102 is provided with the three indentations 102*e*, 102*f* and 102*g* and when the lever 100 is moved to the neutral, forward or reverse position, the abutment member 152*a* snaps into the corresponding one of the indentations 102*e*, 102*f* and 102*g*. The operator can therefore judge the shift position from the manipulation feel of the lever 100.

The stops 120 and 122 are provided with their one ends 120*a* and 122*a* inserted into the remote control box 20 and their other ends 120*b* and 122*b* situated on the movement locus of the projection 118 formed on the support shaft 102 so as to terminate the rotation of the support shaft 102. Moreover, the stops 120, 122 are made interchangeable with other stops 140, 142 with a different positional relationship between their one ends and other ends. This enables the limit angle of rotation of the support shaft 102 to be changed by changing the positions of said other ends, thereby making it possible to change the maximum manipulation angle of the lever 100 (i.e., the manipulation range of the lever 100). As a result, the manipulation range of the lever 100 can be changed in accordance with where and at what angle the remote control box 20 is installed, so as to prevent unnaturalness to the operator and thereby enabling greater freedom in selecting the place where the remote control box 20 is installed.

Since the stops 120 and 122 are changeable in orientation, the positions of their other ends 120*b* and 122*b* can be changed to change the limit angle of rotation of the support shaft 102. The maximum manipulation angle of the lever 100 can therefore be varied to realize greater freedom in selecting the place where the remote control box 20 is installed.

A remote operation system for an outboard motor according to a second embodiment of this invention will now be explained.

In the second embodiment, the plurality of (i.e., two) sensors for detecting the manipulation angle of the support shaft 102 (rotation angle of the support shaft 102) are all (or both) potentiometers that output analog signals.

Figure 19:
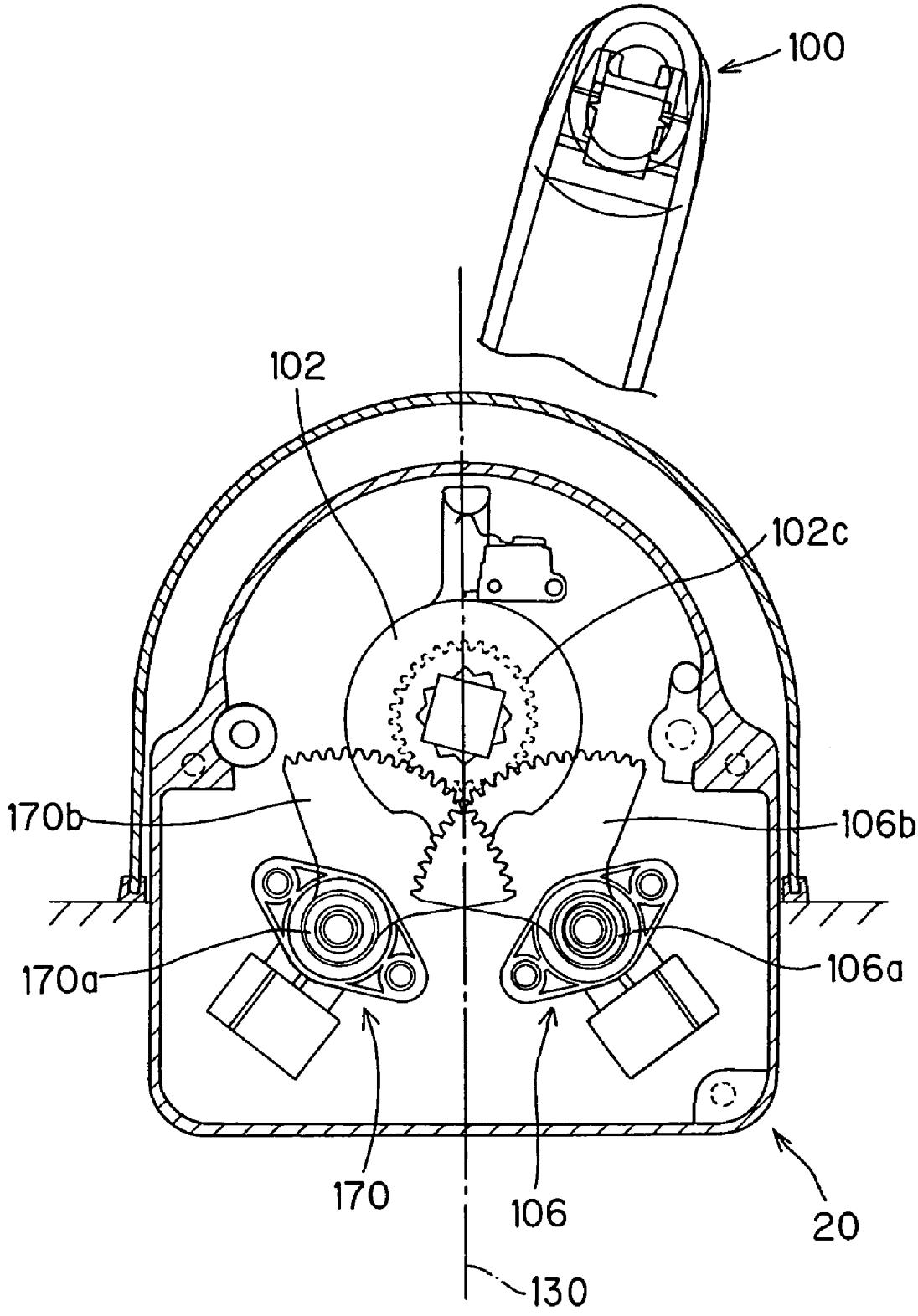
FIG. 19 is an enlarged sectional view showing a remote control box of a remote operation system for an outboard motor according to a second embodiment of the invention.

FIG. 19 is an enlarged sectional view showing the remote control box of the remote operation system for an outboard motor according to the second embodiment of the invention.

In the second embodiment, as shown in FIG. 19, the rotary encoder 108 discussed regarding the first embodiment is replaced with a second potentiometer 170. The potentiometer 106 and second potentiometer 170 are positioned symmetrically with respect to the plane 130. The second potentiometer 170 is of the same type as the potentiometer 106.

The second potentiometer 170 has an input shaft 170*a* provided with a gear 170*b* that, like the gear 106*b* provided on the input shaft 106*a* of the potentiometer 106, is also driven by the first gear 102*c* provided on the support shaft 102. The second gear 102*d* of the first embodiment is unnecessary in the second embodiment and is therefore eliminated from the support shaft 102 shown in FIG. 19.

Normally, the ECU 22 controls the operation of the electric throttle motor 36 and electric shift motor 38 based on the output value of one potentiometer between the potentiometers 106 and 170, but when that potentiometer malfunctions, it controls the operation of the motors 36, 38 based on the output value of the other potentiometer.

Thus in the second embodiment the sensory system is imparted with redundancy by providing two analog sensors (the potentiometer 106 and second potentiometer 170). Therefore, even if one sensor should malfunction, operation of the electric throttle motor 36 and electric shift motor 38 can still be continued based on the output values of the remaining sensor, thereby enhancing the reliability of the system. In addition, the use of two sensors of the same type gives the second embodiment a cost advantage over the first embodiment.

The remaining structural aspects of the second embodiment are the same as those of the first embodiment and will not be explained again. The component layout shown in FIG. 19 is for when the remote control box 20 is installed on the right side of the cockpit 14 but can be modified for installation on the left side. The modification can be made without need to interchange the potentiometer 106 and second potentiometer 170 because the two potentiometers are of the same type.

The first and second embodiments are thus configured to have a remote operation system for an outboard motor (10) mounted on a stern of a boat (12) and having an internal combustion engine (24) and a propeller (30) powered by the engine to propel the boat in a forward direction or in a reverse direction in response to a shift position selected by a shift mechanism, comprising: a remote control box (20) installed at a cockpit (14) of the boat:

a throttle actuator (electric throttle motor 36) installed in the outboard motor and connected to a throttle valve (74) of the engine to open and close the throttle valve; a shift actuator (electric shift motor 38) installed in the outboard motor and operating a clutch (90) of the shift mechanism to select the shift position from among a forward position, a reverse position and a neutral position; a lever (100) attached to a support shaft (102) that is rotatably accommodated in the remote control box in response to manipulation of an operator; a plurality of sensors (106, 108) connected to the support shaft and each generating outputs indicative of an angle of rotation of the support shaft through the lever manipulation; and a control unit (electric control unit 22) electrically connected to the throttle actuator, the shift actuator and the sensors and controlling operation of the throttle actuator and the shift actuator based on at least one of the outputs of the sensors.

In the remote operation system, the plurality of sensors comprises an analog sensor (106) generating the output indicative of the angle of rotation of the support shaft and a digital sensor (108) generating the output indicative of the angle of rotation of the support shaft.

In the remote operation system, the analog sensor is a potentiometer (106) having an input shaft (106*a*) with a gear (106*b*) that meshes with a gear (102*c*) formed on the support shaft.

In the remote operation system, the digital sensor is a rotary encoder (108) having an input shaft (108*a*) with a gear (108*b*) that meshes with a gear (102*d*) formed on the support shaft.

In the remote operation system, the remote control box 20 includes: a case (case body 20*a*, lid 20*b* and cover 20*c*) formed symmetrically with respect to a plane (130) containing a central axis of the support shaft; and a plurality of stops (forward stop 120, reverse stop 122) formed symmetrically with respect to the plane and defining a permissible angle of rotation of the support shaft 102.

In the remote operation system, the plurality of sensors 106, 108 are connected to the support shaft 102 symmetrically with respect to the plane 130.

The remote operation system further includes: a plurality of switches (forward switch 110, neutral switch 112 and reverse switch 114) provided at the remote control box 20 and each generating outputs indicative of a direction of rotation of the support shaft 102; and the control unit controls the operation of the throttle actuator and the shift actuator based on at least one of the outputs of sensors 106, 108 and based on at least one of the outputs of the switches 110 to 114.

In the remote operation system, the switches 110 to 114 are provided at the remote control box 20 symmetrically with respect to a plane (130) containing a central axis of the support shaft 102.

In the remote operation system, the switches comprises a forward switch (110) generating a signal when the support shaft 102 is rotated to a position corresponding to the forward position, a reverse switch (114) generating a signal when the support shaft 102 is rotated to a position corresponding to the reverse position and a neutral switch (112) generating a signal when the support shaft 102 is rotated to a position corresponding to the neutral position.

The remote operation system further includes: a plurality of switches (110 to 114) provided at the remote control box and each generating outputs indicative of a direction of rotation of the support shaft; and the control unit controls the operation of the throttle actuator and the shift actuator based on at least one of the outputs of the digital sensor (108) and the switches (110 to 114), and the output of the analog sensor (106).

In the remote operation system, the support shaft 102 has an elliptical section profile that is pressed by a presser mechanism (150, 152) such that a manipulation load is imparted to the lever 100.

In the remote operation system, the presser mechanism comprising: an abutment member (150*a*, 152*a*) abutting on an outer periphery of the elliptical profile of the support shaft 102; and an elastic member (150*b*, 152*b*) urging the abutment member toward the support shaft 102.

In the remote operation system, the outer periphery of the elliptical profile of the support shaft 102 is formed with a plurality of indentations (102*e*, 102*f*, 102*g*) which the abutment member enters in response to the lever manipulation.

In the remote operation system, the indentations 102*e* to 102*g* are formed with equally spaced intervals.

The remote operation system further includes: a projection (118) formed on the support shaft 102; a first stop (forward stop 120, second forward stop 140) whose one end is connected to the remote control box 20 and whose other end is situated on a movement locus of the projection 118 at a first location to define a first range of permissible angle of rotation of the support shaft 102; and a second stop (reverse stop 122, second reverse stop 142) whose one end is connected to the remote control box 20 and whose other end is situated on the movement locus of the projection 118 at a second location to define a second range of permissible angle of rotation of the support shaft 102; wherein the first and second stops are interchangeable with each other such that the permissible angle of rotation of the lever is changed between the first and second ranges.

The remote operation system further includes: a projection (118) formed on the support shaft 102; a first groups of stops (forward stop 120, second forward stop 140) whose one ends are connected to the remote control box 20 and whose other ends are situated on a movement locus of the projection 118 at a first location to define a first range of permissible angle of rotation of the support shaft 102; and a second group of stops (reverse stop 122, second reverse stop 142) whose one ends are connected to the remote control box and whose other ends are situated on the movement locus of the projection 118 at a second location to define a second range of permissible angle of rotation of the support shaft 102; wherein the first and second groups of stops are interchangeable with each other such that the permissible angle of rotation of the support shaft is changed between the first and second ranges.

Japanese Patent Application Nos. 2004-245888, 2004-245889, 2004-245890, 2004-245891 and 2004-245892 all filed on Aug. 25, 2004 are incorporated herein in their entirety.

While the invention has thus been shown and described with reference to specific embodiments, it should be noted that the invention is in no way limited to the details of the described arrangements; changes and modifications may be made without departing from the scope of the appended claims.

What is claimed is:

1. A remote operation system for an outboard motor mounted on a stem of a boat and having an internal combustion engine and a propeller powered by the engine to propel the boat in a forward direction or in a reverse direction in response to a shift position selected by a shift mechanism, comprising:

a remote control box installed at a cockpit of the boat;

a throttle actuator installed in the outboard motor and connected to a throttle valve of the engine to open and close the throttle valve;

a shift actuator installed in the outboard motor and operating a clutch of the shift mechanism to select the shift position from among a forward position, a reverse position and a neutral position;

a lever attached to a support shaft that is rotatably accommodated in the remote control box for being manipulated by an operator;

a plurality of sensors disposed within the remote control box operatively connected to the support shaft and each generating an output indicative of an angle of rotation of the support shaft through the lever manipulation; and a control unit electrically connected to the throttle actuator, the shift actuator and the sensors, and controlling operation of the throttle actuator and the shift actuator based on at least one of the outputs of the sensors.

2. The remote operation system according to claim 1, wherein the plurality of sensors comprise an analog sensor generating the output indicative of the angle of rotation of the support shaft and a digital sensor generating the output indicative of the angle of rotation of the support shaft.

3. The remote operation system according to claim 2, wherein the analog sensor is a potentiometer having an input shaft with a gear that meshes with a gear formed on the support shaft.

4. The remote operation system according to claim 2, wherein the digital sensor is a rotary encoder having an input shaft with a gear that meshes with a gear formed on the support shaft.

5. The remote operation system according to claim 1, wherein the plurality of sensors comprise analog sensors each generating the output indicative of the angle of rotation of the support shaft.

6. The remote operation system according to claim 5, wherein the analog sensors are potentiometers each having an input shaft with a gear that meshes with a gear formed on the support shaft.

7. The remote operation system according to claim 1, wherein the remote control box includes:

a case formed symmetrically with respect to a plane containing a central axis of the support shaft; and a plurality of stops formed symmetrically with respect to the plane and defining a permissible angle of rotation of the support shaft.

8. The remote operation system according to claim 7, wherein the plurality of sensors are connected to the support shaft symmetrically with respect to the plane.

9. The remote operation system according to claim 1, further including:

a plurality of switches provided at the remote control box and each generating an output indicative of a direction of rotation of the support shaft;

and the control unit controls the operation of the throttle actuator and the shift actuator based on at least one of the outputs of the sensors and based on at least one of the outputs of the switches.

10. The remote operation system according to claim 9, wherein the switches are provided at the remote control box symmetrically with respect to a plane containing a central axis of the support shaft.

11. The remote operation system according to claim 9, wherein the switches comprise a forward switch generating a signal when the support shaft is rotated to a position corresponding to the forward position, a reverse switch generating a signal when the support shaft is rotated to a position corresponding to the reverse position and a neutral switch generating a signal when the support shaft is rotated to a position corresponding to the neutral position.

12. The remote operation system according to claim 2, further including:

a plurality of switches provided at the remote control box and each generating an output indicative of a direction of rotation of the support shaft;

and the control unit controls the operation of the throttle actuator and the shift actuator based on at least one of the outputs of the digital sensor and the switches, and the output of the analog sensor.

13. A remote operation system, for an outboard motor mounted on a stern of a boat and having an internal combustion engine and a propeller powered by the engine to propel the boat in a forward direction or in a reverse direction in response to a shift position selected by a shift mechanism, comprising:

a remote control box installed at a cockpit of the boat;

a throttle actuator installed in the outboard motor and connected to a throttle valve of the engine to open and close the throttle valve;

a shift actuator installed in the outboard motor and operating a clutch of the shift mechanism to select the shift position from among a forward position, a reverse position and a neutral position;

a lever attached to a support shaft that is rotatably accommodated in the remote control box for being manipulated by an operator, wherein the support shaft has an elliptical section profile that is pressed by a presser mechanism such that a manipulation load is imparted to the lever;

a plurality of sensors operatively connected to the support shaft and each generating an output indicative of an angle of rotation of the support shaft through the lever manipulation; and a control unit electrically connected to the throttle actuator, the shift actuator and the sensors, and controlling operation of the throttle actuator and the shift actuator based on at least one of the outputs of the sensors.

14. The remote operation system according to claim 13, wherein the presser mechanism comprises:

an abutment member abutting on an outer periphery of the elliptical section profile of the support shaft; and an elastic member urging the abutment member toward the support shaft.

15. The remote operation system according to claim 14, wherein the outer periphery of the elliptical section profile of the support shaft is formed with a plurality of indentations which the abutment member enters in response to the lever manipulation.

16. The remote operation system according to claim 15, wherein the indentations are formed with equally spaced intervals.

17. The remote operation system according to claim 1, further including:

a projection formed on the support shaft;

a first stop having one end connected to the remote control box and another end situated on a movement locus of the projection at a first location to define a first range of permissible angle of rotation of the support shaft; and a second stop having one end connected to the remote control box and another end situated on the movement locus of the projection at a second location to define a second range of permissible angle of rotation the support shaft;

wherein the first and second stops are interchangeable with each other such that the permissible angle of rotation of the lever may be selectively changed between the first and second ranges.

18. The remote operation system according to claim 1, further including:

a projection formed on the support shaft;

a first group of stops having first ends connected to the remote control box and second ends situated on a movement locus of the projection at a first location to define a first range of permissible angle of rotation of the support shaft; and a second group of stops having first ends connected to the remote control box and second ends situated on the movement locus of the projection at a second location to define a second range of permissible angle of rotation of the support shaft;

wherein the first and second groups of stops are interchangeable with each other such that the permissible angle of rotation of the support shaft may be selectively changed between the first and second ranges.

* * * * *